US008517847B2

(12) United States Patent
Crawford et al.

(10) Patent No.: US 8,517,847 B2
(45) Date of Patent: Aug. 27, 2013

(54) OMNITABLE RIDE SYSTEM

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 248 days.

(21) Appl. No.: 13/225,810

(22) Filed: Sep. 6, 2011

(65) Prior Publication Data

US 2013/0059670 A1 Mar. 7, 2013

(51) Int. Cl.
*A63G 1/10* (2006.01)
*A63G 1/38* (2006.01)

(52) U.S. Cl.
USPC ..... 472/36; 472/47

(58) Field of Classification Search
USPC ..... 472/28–38, 43–47, 130, 131; 434/29, 434/55, 58
See application file for complete search history.

(56) References Cited

U.S. PATENT DOCUMENTS 3,985,352 A * 10/1976 Nitzsche ..... 472/19
6,851,748 B1 * 2/2005 Garrick ..... 297/240
6,910,971 B2 * 6/2005 Alsenz ..... 472/59

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A circular omnimover or omnitable ride system. The ride system includes a stationary, centrally-located platform for loading and unloading passengers. A turntable assembly is provided that includes a turntable with an upper surface substantially coplanar with an upper surface of the platform. The turntable has a centrally-located hole or passageway defined by an inner sidewall to receiving the non-rotating platform. Passenger vehicles are mounted along an outer edge of the turntable via translation mechanisms. A drive mechanism rotates the turntable about a central axis at a constant rate. The vehicles are moved through a station space and a show space during one or two full rotations of the turntable. The passenger vehicles are loaded and unloaded in the station space via the platform and then dispatched by the translation mechanism into the show space, which may involve increasing the vehicle's radius and changing its vertical position relative to the turntable.

20 Claims, 13 Drawing Sheets

OMNITABLE RIDE SYSTEM

BACKGROUND

1. Field of the Description

The present description relates, in general, to providing amusement park rides that provide high throughput and high daily capacities. More particularly, the present description relates to a ride system (or ride, ride apparatus, or the like) to provide a new and unique omnimover-type ride to achieve a ride experience with increased immersion and dynamic variability while preserving or even improving upon the benefits of prior omnimover rides.

2. Relevant Background

Amusement and theme parks continue to be popular worldwide with hundreds of millions of people visiting the parks each year. Historically, park operators provided walk-through attractions that presented artwork, music/soundtracks, and special effects with museum, haunted house, movie and book-based, other themes. These attractions were popular with many visitors of the parks, but park operators had difficulty increasing the daily capacity of such attractions because many visitors or attraction participants would linger in various portions of the attraction or even reverse direction in an attempt to visit prior portions of the attraction. As a result, walk-through attractions have generally been replaced by attractions in which the visitors (or passengers) ride in vehicles along a track or path through the attraction.

With the goal of providing higher ride or attraction capacity with a simple and reliable system in mind, omnimover rides have been utilized in many theme parks. An omnimover is a ride system that has been developed to provide an experience that is similar to a walk-through experience or ride-through tour as it moves guests at speeds similar to walking speed such as less than about 2 feet per second. The omnimover is a ride system used for theme park attractions such as haunted houses or movie-based theme attractions in which two, three, or more passengers sit in a vehicle that is towed or moved along a track. The omnimover ride system includes a large number of such vehicles that seat 2 to 4 passengers and are each attached or linked into a continuous loop or chain. The vehicle chain moves along a track, with the track typically hidden beneath a floor.

The chain of vehicles is kept in continuous and predictable motion, typically at a constant speed, throughout the entire course of the attraction such as along an irregular path to move through the rooms of a house or set of a show or attraction. High throughput or increased daily capacity is achieved because the vehicle chain has very closely spaced vehicles that move continuously, with riders loading and unloading while the vehicles are in motion. Standard loading and unloading occur at designated locations along the ride path from either a normal floor or from a moving walkway adjacent to the vehicle path.

The omnimover ride system continues to provide a popular platform for rides in many amusement parks as the omnimover ride system effectively delivers high capacity with a simple mechanical drive and control system. One consideration, though, with the use of omnimover ride systems is that due to the constant speed and limited vehicle movements the ride experience is relatively predictable and provides a similar experience regardless of the show. Hence, there remains a need for a ride system that provides the high capacity or passenger throughput and the simple mechanism of a conventional omnimover ride but that also provides a new, unique, fun, exciting, and unpredictable ride experience. Preferably, such a ride system would increase immersion into the ride experience and enhance variability while preserving the benefits of conventional omnimover rides including high capacity, a continuous chain of vehicles, and a simple and/or well-known propulsion and control system for moving the vehicle chain.

SUMMARY

The present description addresses the above and other problems by providing a ride system that is labeled an omnitable ride system because it provides an omnimover-type ride in which passengers may load and unload vehicles from a central or interior loading platform while the vehicles continue to move through the station. The ride system also is similar to prior omnimover rides in that the vehicle attachment points are typically moved through the entire ride at constant speeds. The term "table" is included in the ride system name ("omnitable") because the ride system includes a turntable assembly with a turntable that acts as the primary vehicle support and propulsion and is rotated by a drive mechanism about a central rotation axis.

Passenger vehicles are attached to the rotating turntable such that the attachment point rotates with the turntable, and the ride space may be divided into a station space for loading/unloading and one or more show spaces such that the vehicles are moved at one or more radii through the station and then through a show space. The rotation rate is maintained relatively low to allow loading/unloading of moving vehicles such as less than 4 feet per second or the like, and each ride cycle may be 1 to 3 rotations (or more) of the turntable about its rotation axis. The vehicles are each mounted to the turntable with an attachment assembly or translation mechanism, and the attachment assemblies may support the vehicles at a fixed radius while other preferred embodiments allow the vehicle radius to be changed during rotation.

These latter embodiments allow a smaller radius and corresponding lower vehicle velocity to be provided in the station space for loading/unloading and a larger radius and corresponding higher vehicle velocity to be provided in the show space of the ride for added excitement and variability of the ride experience. The translation or repositioning of the vehicle by the attachment assembly may simply be radial or may involve a support arm mounted on the rotating platform being pivoted through a range of angles, e.g., 0 degrees with the vehicle in a load/unload position and a minimum radial location to 90 degrees for a first show position at an intermediary radial location and maximum height above the turntable's upper surface to 180 degrees or more for a second (or greater) show position at a maximum (or larger) radial location and third height relative to the turntable's upper surface (which may be above, equal to, or below the turntable's uppers surface).

As will become clear from this description, the omnitable ride system is a turntable-based ride platform that allows for a large number of vehicles to be mounted around the perimeter of the rotating structure. Vehicles are moved by the ongoing and, generally, continuous, rotation of the turntable from a loading/unloading station into a themed show environment. The vehicles are then moved or returned to the station area where the passengers are unloaded while the vehicles continue to move with the turntable.

Vehicles may be mounted on the turntable at a fixed radii (such as at or near the peripheral edge/side of the turntable) or may be connected through a translation/positioning mechanism such that they can each be independently moved and/or oriented with respect to the turntable and/or show elements provided along the generally circular ride path (or at least arcuate along each ride section in embodiments in which the radial vehicle position is varied during rotation). This allows for a unique and new ride experience to be delivered with relatively simple drive design as well as providing some degree of passenger control of the vehicles in some embodiments (e.g., a passenger may be able to operate a joystick or other user input to change the angular position of the support arm within a preset window or change the radial position within a present radius range).

More particularly, a ride system is provided that may be operated to achieve an omnimover ride with a generally circular path. Significantly, passenger vehicles are "chained" together as with prior omnimovers, but the vehicles may have varying velocities by changing their radial positions along differing portions of the ride path (e.g., a smaller radius in a station to facilitate loading and unloading and a greater radius in a show space or portion of the ride path to increase vehicle velocity such as by 50 to 100 percent or more). The ride system includes a stationary and centrally-located platform for loading and unloading passengers and a turntable assembly.

The turntable assembly includes a turntable with an upper surface substantially coplanar with an upper surface of the platform. In a typical embodiment, the turntable has a centrally-located hole defined by an inner sidewall for receiving the platform, e.g., the turntable is donut-shaped and rotated about the periphery of the non-rotating central platform. The turntable assembly also includes passenger vehicles mounted along an outer edge of the turntable, and each of the passenger vehicles is coupled to the turntable with a translation mechanism (which may also be thought of as a vehicle attachment and positioning assembly). The turntable assembly also includes a drive mechanism rotating the turntable about a central axis extending upward through the platform at a substantially constant rate during operation of the ride system. In the ride system, the passenger vehicles are moved through a station space and a show space during a rotation (or rotations in some cases) of the turntable about the center axis. In practice, the passenger vehicles are loaded and unloaded in the station space via the platform with the drive mechanism operating to rotate the turntable to provide loading/unloading from the interior portion of the ride.

In some embodiment of the ride system, the rate of rotation of the turntable is selected such that vehicle speed is in the range of 1 to 4 feet per second in the station and show spaces. In some cases, the translation mechanisms are configured and operated to position the passenger vehicles in a load and unload position when the passenger vehicle is moved through station space and to position the passenger vehicles in a show position when the passenger vehicle is moved through the show space. In many embodiments, each of the vehicles has a vehicle radius that is greater when in the show space such that it also has a higher velocity. The vehicle radii may be adjusted or set by the translation mechanism such that each of the passenger vehicles have a vehicle speed in the range of 1 to 2 feet per second in the station space and a vehicle speed that is in the range of 2 to 4 feet per second in the show space. In some embodiments, the translation mechanisms are each further configured to place each of the passenger vehicles at a first height in the station space, whereby each of the passenger vehicles are adjacent to the upper surface the turntable or the platform and at a second height differing from the first height in the show space.

In some ride system embodiments, the translation mechanisms are operated such that adjacent vehicles are placed on a different section of a ride path for the ride system including positioning the adjacent vehicles at differing radii or heights above the upper surface of the turntable. In this way, vehicle spacing in the show space may be significantly increased to enhance the ride experience. Each of the translation mechanisms may include a support arm pivotally coupled to the turntable at a first end and supporting one of the passenger vehicles. In such cases, the translation mechanisms each operate (such as based on control signals from an onboard or offboard controller) to pivot the support arm to place the passenger vehicle adjacent to the upper surface of the turntable or the platform as the passenger vehicle is moved through the station space and to pivot the support arm to place the passenger vehicle in a spaced-apart relationship to the upper surface of the turntable in as the passenger vehicle is moved through the show space. Each of the translation mechanisms may be configured to pivot the support arm through an angular rotation of more than 180 degrees, whereby the passenger vehicles are positionable in a show position above or below the upper surface of the turntable.

DETAILED DESCRIPTION

Figure 1:
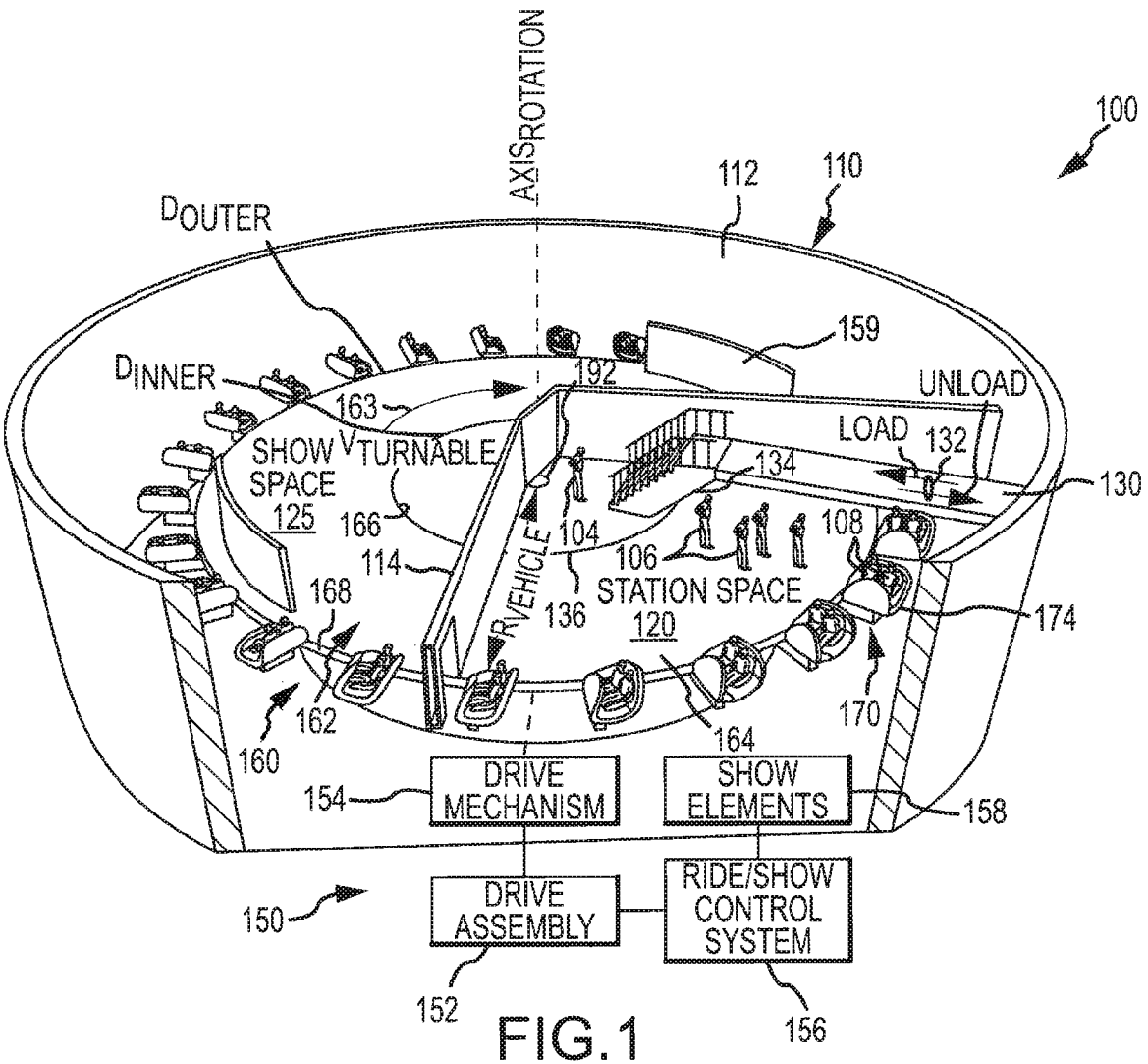
FIG. 1 is a perspective, overhead view of an omnitable ride system shown in part in functional block form to illustrate components hidden by the turntable assembly and with a partial cutaway of the outer wall or enclosure to better show components of the ride system.

Embodiments of the present description are directed to an improved omnimover ride system that may be labeled an omnitable ride or omnitable ride system. Briefly, the omnitable ride system includes a turntable that is rotated about its central axis. A stationary platform may be provided in the center of the turntable for use in passenger loading and unloading such that the turntable is donut shaped and rotates about the stationary load/unload platform.

Vehicles may be rigidly mounted to a peripheral or outer edge/side of the turntable in some embodiments. In other cases, a plurality of mounting or attachment assemblies are provided to support each vehicle, and each vehicle mounting assembly may include a translation or vehicle positioning mechanism that is configured to first position the vehicles at a radial position in or adjacent to the loading/unloading platform (or place the vehicles in a load/unload position) and then second position the vehicles in one or more greater radial positions spaced apart from the loading/unloading platform (or place the vehicles in one or more show positions). The translation mechanism may move the vehicles radially in and out or may be adapted to vary the vehicle height relative to the upper surface of the turntable (and loading/unloading platform) while it is changing the radial position of the vehicles. The translation vehicles may be operated to set differing vehicle heights or elevations for alternating vehicles so as to increase vehicle spacing (e.g., a first half of the vehicles may be in a turntable rotation that involves vehicles unloading/loading and a first show portion and a second half of the vehicles may be in a second turntable rotation that involves a second show portion).

The ride cycle may be one, two, or more rotations of the turntable, which is rotated at a relatively slow rate to allow vehicle loading and unloading while the turntables and vehicles mounted to the turntable continue to rotate about the center axis or rotation axis. Significantly, the generally circular ride path is divided into a load/unload (or station) space or section and a show space or section. For example, a ride cycle may involve one rotation of a turntable, and the load/unload section may involve one sixth to one fourth of the rotation (60 to 90 degrees or the like) while the show may be provided in the remaining three fourths to five sixths of the rotation (270 to 300 degrees or the like of the available 360 degrees of rotation). In some rides, the ride cycle may be two full rotations with the station being a fraction of a first rotation and the show being provided in the remaining fraction of the first rotation and the complete second rotation. In a two rotation ride, a translation mechanism that changes the vertical position of the vehicle may be used to place the vehicles in differing show portions. For example, loading/unloading is provided with a vehicle elevation of 0 feet, a first show portion in the first rotation may be provided with a vehicle elevation of 10 to 20 feet above the turntable, and a third show portion in the second turntable rotation may be provided with a vehicle elevation of −20 to 10 feet relative to the upper surface of the turntable, with the translation mechanism providing the repositioning of the vehicles.

Generally, the omnitable ride system is a large rotating structure capable of supporting multiple passenger vehicles and rotating in such a way as to move the vehicles through a show space and a station where passengers can load and unload while the structure continues to rotate (and the vehicles continue to move along the circular ride path such as a 1 to 4 feet per second (FPS)). For each vehicle, an attachment assembly is provided that connects the vehicle to the rotating structure such that the attachment assembly and supported vehicle rotate with the turntable. A drive system is included that is operated by a ride/show control system to move the entire rotatable structure (e.g., rotate the turntable, with attachment assemblies each positioning a passenger vehicle, about its center or rotation axis) such that the vehicle speed is in the range of 1 to 4 FPS. The ride system also includes a track, guide, or bearing assembly that ensures the rotating structure is constrained to rotate in a circle about a rotation axis. Further, a power distribution and control system is included that delivers power and control signals to equipment located on the moving structure or turntable and ensures safe and consistent operation of the ride system under all operating, maintenance, and failure conditions.

In some embodiments, the main rotating structure takes the form of a turntable with or without a stationary central platform for use in vehicle loading/unloading from an interior or central location. The vehicles in some cases are attached to the turntable to be at a fixed radius such as at mounting locations about the perimeter of the turntable. In other cases, though, the vehicles are attached or mounted via translation mechanisms such that their radial positions relative to the rotation axis of the turntable can be varied during a ride cycle or rotation of the turntable.

For example, the vehicles may be mounted to, and be free to move along, radial guide ways or support arms (e.g., telescoping booms in or nearly in the horizontal plane of the turntable) attached to the turntable. In other examples or embodiments, each vehicle is attached to the perimeter of the turntable with an articulable mount or translation mechanism that is capable of moving the vehicle in at least one degree of freedom (X, Y, Z, pitch, roll, or yaw) relative to the turntable. In some cases, the translation mechanism takes the form of a rotatable arm attached to the perimeter or near an outer edge/side of the turntable, and an actuator is used to pivot the arm about a first end proximate to the turntable to position the vehicle on or near the turntable upper surface (e.g., for loading/unloading) and off the turntable upper surface to one or more show positions (e.g., between a height or elevation of 0 feet or a support arm angle of 0 degrees to a height or elevation of −30 to 30 feet or the like (limited, for example, only by the length of the support arm and show/ride space limitations) or a support arm angle of 0 to 240 degrees or more as measured from the upper turntable surface).

Vehicle motion may be computer controlled with show/ride control software or programming to follow a specific show profile and/or may be controlled using mechanical techniques such by driving vehicle movements with a cam/rail system. In some cases, passenger input via a user input or interactive device in the vehicle may be used to control some of the vehicle movements and positions such as to cause a vehicle to spin about an axis on the mounting or translation mechanism or to change the vehicle height/elevation within a preset window or range associated with a section of a ride path (or radial position of the turntable). Rolling idler wheel assemblies may be used as side guides to constrain the motion of the system or turntable to circular rotation. A ride cycle may be defined as one or more complete rotations of the turntable, and the vehicles are typically prevented from moving relative to the turntable while they are being moved through the station to allow for safe loading/unloading of the passengers.

Figure 2:
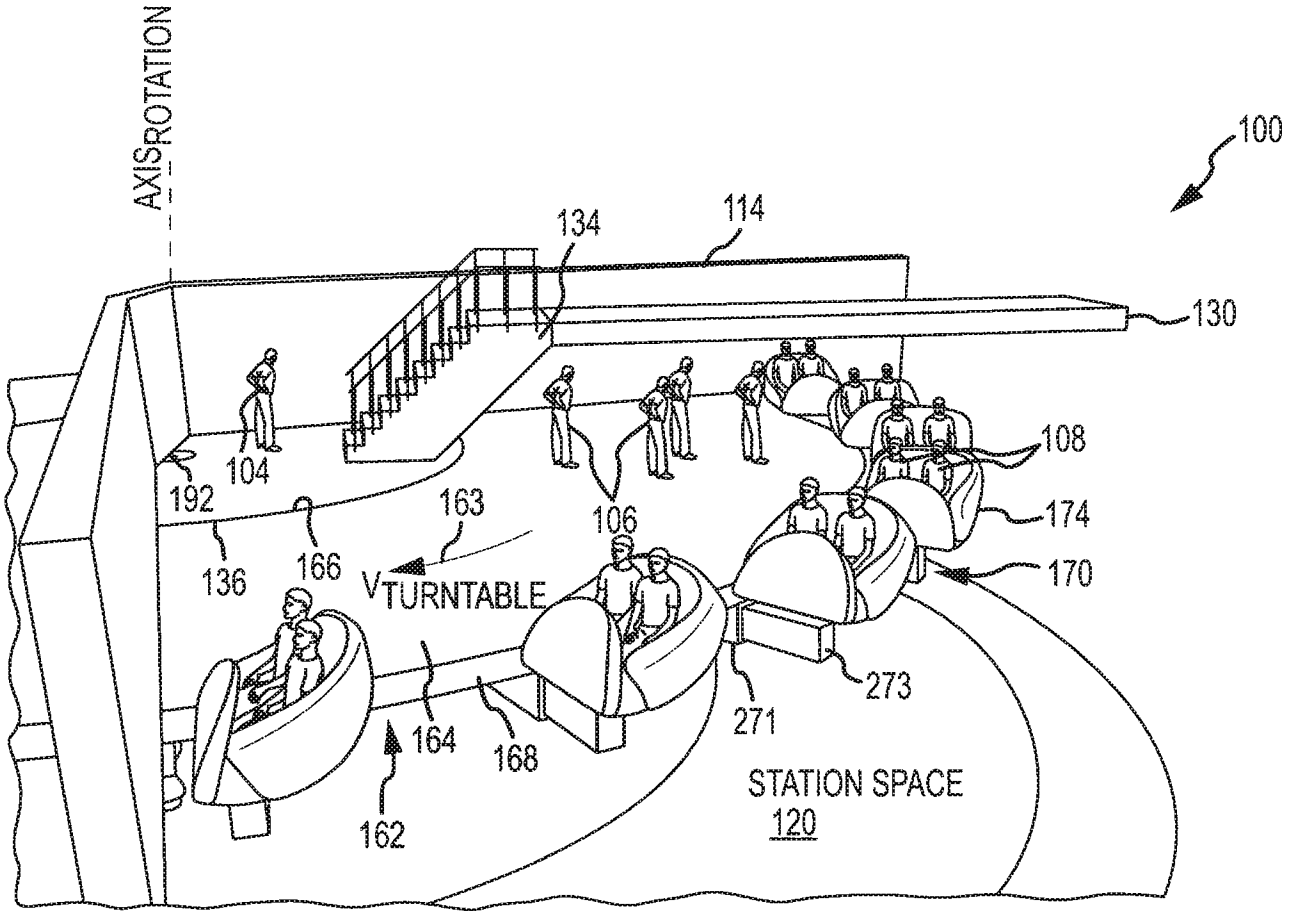
FIG. 2 illustrates a close up of a portion of the omnitable ride system of FIG. 1 showing the station space or area in more detail including use of an attachment or mounting assembly to attach passenger vehicles to the rotating turntable at a fixed vehicle radius relative to the center or rotation axis of the ride system (e.g., an axis passing through a center point of a stationary platform used as part of the unload/load station or the ride system)

FIG. 1 illustrates a top perspective view of an omnitable ride system 100 of an embodiment of the present invention while FIG. 2 shows the station 120 of the ride system 100 in greater detail. The view of FIG. 1 includes a cutaway of outer wall or enclosure 110 as well a functional block portion to facilitate explanation of the features of ride system 100. As shown, the ride system 100 includes an enclosure or outer wall 110 defining a volume or space for providing a ride or attraction. This interior space is divided into a station or station space 120 and a show space 125, and an inner or dividing wall 114 is used in the ride system 100 to define these spaces 120, 125 and to limit a passenger's ability to view the show space 125 while in the station 120 (and vice versa).

The outer wall 110 includes an inner or inward-facing surface(s) 112 that can be used to present and support show elements to vehicle passengers as vehicles are moved through a show space 125 or along a ride path that passes through the show space 125. Additional show elements may be provided on the turntable 162 to move with the vehicles as shown with show element (display screen or device) 159 while other show elements may be provided on the non-rotating or stationary inner platform 136 so as to only be viewed during portions of the ride path (or only when a vehicle is at a particular angular position and/or height or range of such angular positions and/or heights). Each vehicle may be rotated or spun on an axis extending through the vehicle as desired to cause its passengers to face and view the show elements such as element 159 or elements on inner surfaces 112 of wall 110.

The ride system 100 includes a drive and control system 150 with a drive assembly 152 that may include devices for ensuring that the turntable 162 rotates in a circular path or about the rotation or center axis, $Axis_{Rotation}$. The system 150 includes one or more drive mechanisms or propulsion systems 154 that function to rotate the turntable 162 about the axis, $Axis_{Rotation}$. The rotation rate or speed, $V_{Turntable}$, as shown with arrow 163 typically is relatively low or slow such that the speed of the transition surface across which passengers must step is kept within a range that allows the ride system 100 to act as an omnimover in which passengers 106 can load/unload from the moving vehicles 174. For example, the relative speed or velocity between stationary and moving platforms may be 0.5 to 1 FPS or the like and the turntable velocity, $V_{Turntable}$, provided by the drive mechanism 154 is selected based on the size of the turntable 162 and radii at which the transition point occurs relative to the rotation axis, $Axis_{Rotation}$, such that the differential speed is within this range, especially within the station 120 for safe loading/unloading. Also, typically, the turntable velocity 163 is held relatively constant during operations of the ride 100 by the drive mechanism 154, and the turntable 162 is rotated on an ongoing basis (without stopping) even during loading/unloading.

The control and drive system 150 includes a controller 156 that functions to provide operating signal and/or power to the drive assembly 152. The controller 156 may take the form of a computer or similar device with a processor, memory, and input/output devices and run a ride program to operate the drive assembly. Further, the controller 156 may be used to operate the vehicle attachment or translation mechanism (such as mechanism 170) used to attach vehicles (such as vehicle 174) to the turntable 162. This may involve simple rotation of the vehicle 174 on a rotation axis to cause the vehicle 174 to face a particular direction to allow passengers 108 to view show elements. In other cases, though, operation of the attachment mechanism 170 involves repositioning the vehicle 174 at least from a load/unload position while the vehicle 174 is in the station 120 to a show position while the vehicle 174 is in the show space 125.

The movement of the vehicle 174 may involve radial movement alone (e.g., minimum radius for loading/unloading and a larger radius for use in show space 125) or may involve changing the height/elevation of the vehicle 174 relative to the upper surface 164 of the turntable (e.g., on the surface 164 in the station 120 and above, even with, or below the surface 164 in the show space 125). The operation of the translation mechanism 170 may be performed by the control system 156 based on the ride program to move the vehicle 174 to cause it to follow a preset ride profile and/or to follow a present ride path. Along with movement of the vehicles that are attached to the turntable 162, the controller 156 may also operate, such as via software in the form of a ride control program, to operate show elements in a manner that is synchronized with movement of the vehicles, such as vehicle 174, through the show space 125.

The ride system 100 includes a center platform 136 that is stationary or non-rotating (i.e., does not rotate with turntable 162), and the rotation axis, $Axis_{Rotation}$, passes through the platform 136 at a center point or location 192. A ramp, bridge, or tunnel 130 is provided in the station 120 that extends over or under the turntable 162 from the outer wall 110 to the platform 136, with a set of steps or stairs 134 extending down to the platform 136. The bridge 130 is used as a walkway for passengers as shown with arrows 132.

Significantly, the ride system 100 includes a turntable assembly 160 that is adapted to allow the ride system 100 to function as a circular omnimover or omnitable ride. As shown, the turntable assembly 160 includes a turntable 162 that is supported within the ride system 100 such that it can be rotated 163 about the center or rotation axis, $Axis_{Rotation}$, by the drive mechanism 154. The platform 162 may have a planar upper surface 164 to allow passengers 106 to easily walk across it to and from vehicles 174 during loading/unloading in the station 120. The upper surface 164 may be donut shaped with a hole with an inner diameter, $D_{Inner}$, defined by inner sidewall 166 and then extend outward to an outer sidewall 168 at an outer diameter, $D_{Outer}$. The outer diameter, $D_{Outer}$, may be relatively large such as 60 to 100 feet or more.

The platform 162 is rotated about the platform 136, and the inner diameter, $D_{Inner}$, is chosen to be substantially equal to the outer diameter of the circular platform 136 (e.g., a few inches greater than the outer diameter of the platform 136). The mating surfaces between the platform 136 and inner sidewall 166 of the turntable 162 define a transition point between the non-rotating platform 136 and the rotating upper surface 164, and passengers step over this transition point or "crack" during loading and unloading operations in the station 120. For example, a passenger 104 first walks 132 across the bridge 130 and down the steps 134 to the non-rotating platform 136. The passenger 104 may then step across the transition point or seam between platform 136 and turntable 162 onto moving 163 upper surface 164 to join passengers 106. Due to the smaller inner diameter, $D_{Inner}$, the velocity of the surface 164 near the platform 136 is lower so that the change from a stationary platform 136 to a moving turntable 162 is not as great (e.g., a speed of 1.5 to 2 FPS or the like at the inner wall 166). The passengers 106 then walk outward to the vehicles 174 and load as shown with passengers 108. The rate of movement of the upper surface 164 increases as the outer sidewall 168 and outer diameter, $D_{Outer}$, are approached (e.g., from 1.5 to 2 FPS up to 2 to 3 FPS or the like). This allows for an advantageous loading situation since guests are able to transition from the non-moving interior space to the moving turntable surface at a minimum radius where the differential speed between the two surfaces is relatively low. Guests may then be guided to the parked vehicles and load or unload from the vehicles with no relative motion between them and the vehicles. This is significantly better than most omnimover systems where guests load from moving belts that often run at a different speed than the vehicles.

As shown, the turntable assembly 160 includes a number of vehicles 174 adapted for seating one to four or more passengers 108. The vehicles 174 are mounted to the turntable 162 via an attachment assembly or translation mechanism 170. In some embodiments, the attachment assembly 170 may be configured to change the radial position of the vehicle 174 during rotation of the ride while other embodiments may also change the height of the vehicle 174 relative to the upper surface 164 of the turntable 162. However, in some embodiments, the vehicle 174 is retained at a fixed radius, $R_{Vehicle}$. For example, as shown, the attachment assembly 170 may include a plurality of spaced apart channels 271 about the perimeter of the turntable that are attached to a lower surface of the turntable 162, which may be a planar element. Then, a support arm 273 may be mounted at a first end to the channel 271 and extend outward from the outer sidewall 168 of the turntable to a second end. The vehicle 274 may then be coupled to the support arm 273 in a rigid/fixed manner or for selective rotation/pivoting or other movements. In the illustrated ride system 100, the vehicles 174 are locked against or near the edge or outer sidewall 168 such that the its radial position, $R_{Vehicle}$, is just slightly larger than one half of the diameter, $D_{Outer}$, of the turntable 162 (e.g., larger by about half the width of a body of the vehicle 174 when measured between the center of the vehicle 174 and the center or rotation axis, $Axis_{Rotation}$).

Figure 3:
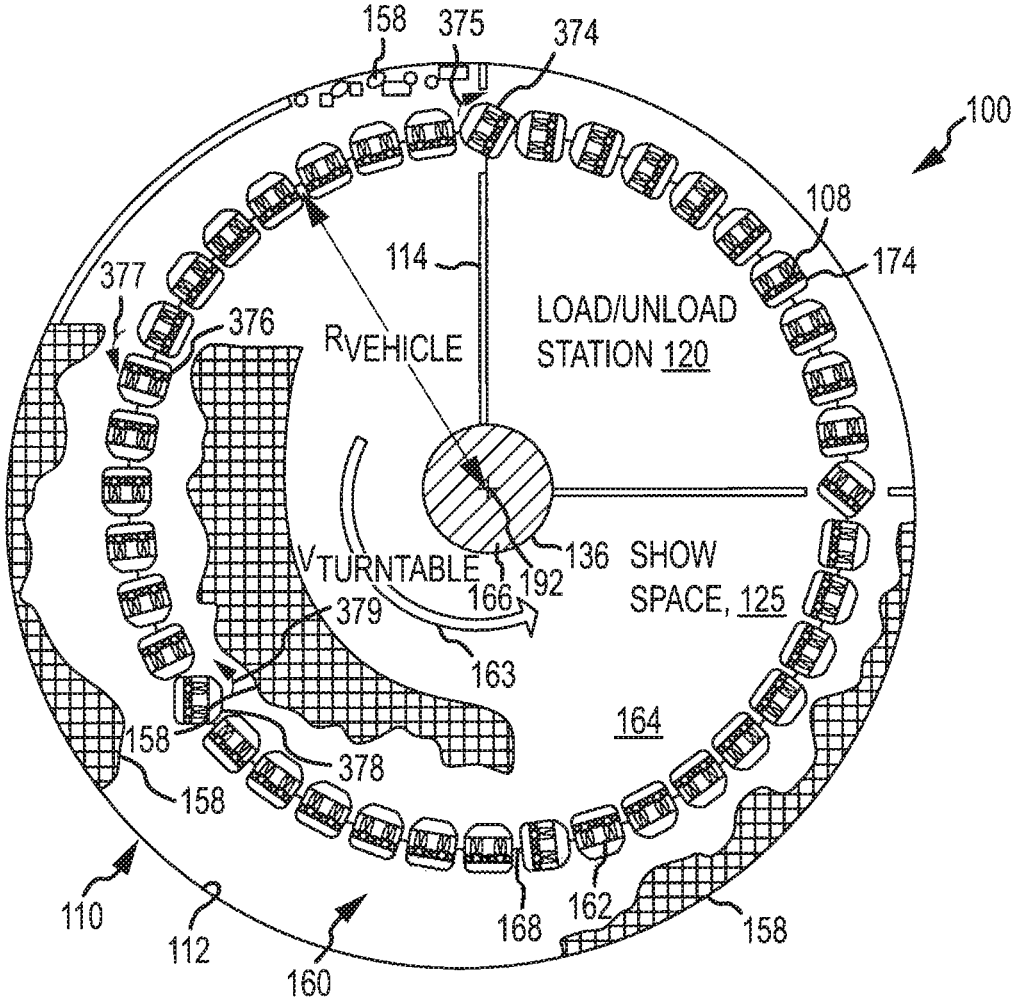
FIG. 3 is a plan (or overhead) view showing the ride system of FIG. 1 provided in a schematic format illustrating movement of the passenger vehicles through the load/unload ride section and through the show section in which the vehicles are rotated about a pivot axis extending through each vehicle and its attachment or mounting assembly, which is labeled as a translation mechanism or vehicle positioning mechanism in some embodiments and is used to attach the vehicle to the turntable.

FIG. 3 illustrates a top or plan schematic view to the ride system 100 of FIG. 1. As described above, the embodiment may be used to provide an omnimover with a circular ride path. Because the vehicles 174 are at a fixed radius and height, the ride cycle of the ride system 100 would likely be one full rotation about the axis passing through the center point 192 of platform 136. The vehicles 174 are loaded from an inner location or interior side via the stationary platform 136 and a portion of the upper surface 164 of turntable 162 passing through the load/unload station 120. As shown, the station 120 makes up one fourth of the full rotation (e.g., about 90 degrees of the full 360 degrees), but other embodiments may utilize a smaller or larger station 120. Interior walls 114 are used to separate the station 120 from the show space 125, which makes up the other portion of the ride cycle (e.g., about 270 degrees of the full 360 degrees in this example).

In the station 120, the vehicles 174 are positioned to face forward along the ride path (e.g., the vehicle body is orthogonal to the sidewall 168) to facilitate loading/unloading. As the vehicles 174 pass through an opening in the wall 114 or a "dispatch point," the vehicles 174 may be rotated as shown at 375 for vehicle 374 to face show elements 158 provided on or near to inner surface 112 of the outer wall or enclosure structure 110 or provided elsewhere in the show space 125. Then, as the turntable 162 is further rotated, the vehicles may be rotated again such as to face forward again as shown with arrow 377 for vehicle 376. Next, as shown with vehicle 378, the vehicles may be rotated from facing forward to face inward toward platform 136 toward show elements 158 provided on the upper surface 164 of rotating turntable 162 (or hanging down from above so as to not move with the turntable 162). Of course, many other rotation patterns may be used to provide a desired ride profile with ride system 100, and, as the vehicles 174 return to the station 120, the vehicles 174 are typically rotated back to face forward and are locked in place to ensure no further movement while in the station 120 for safe and easy unloading and loading. The turntable 162 continues to be rotated 163 about the center rotation axis even as vehicles enter and leave the station 120.

As discussed above, it may be desirable in many embodiments to design and/or configure the attachment assembly such that it is capable of repositioning or moving the passenger vehicle during operations (i.e., rotation of the turntable) of a ride system. In such cases, the attachment assembly may be thought to include a translation mechanism that moves the vehicle between at least a first position and a second position such as between a load/unload position and a show position. In some embodiments, the translation mechanism may place the vehicle in multiple show positions or each show position may include a range of vehicle positions relative to the turntable.

Hence, the vehicles may be hard mounted or be connected through some form of motion base system that allows each of the vehicles to move relative to the turntable as the turntable is rotated to move each of the vehicles along a ride path and through a show(s). Each translation mechanism supports a vehicle along a radial location about the perimeter of the turntable such that the vehicles do not have overlapping workspace and there is no possibility for vehicle-to-vehicle collisions. All motion capability would be disabled in the station, and vehicles would be moved by the translation mechanism to be positioned in a load/unload position adjacent or upon the upper surface of the turntable and then oriented for each loading and unloading.

Figure 4:
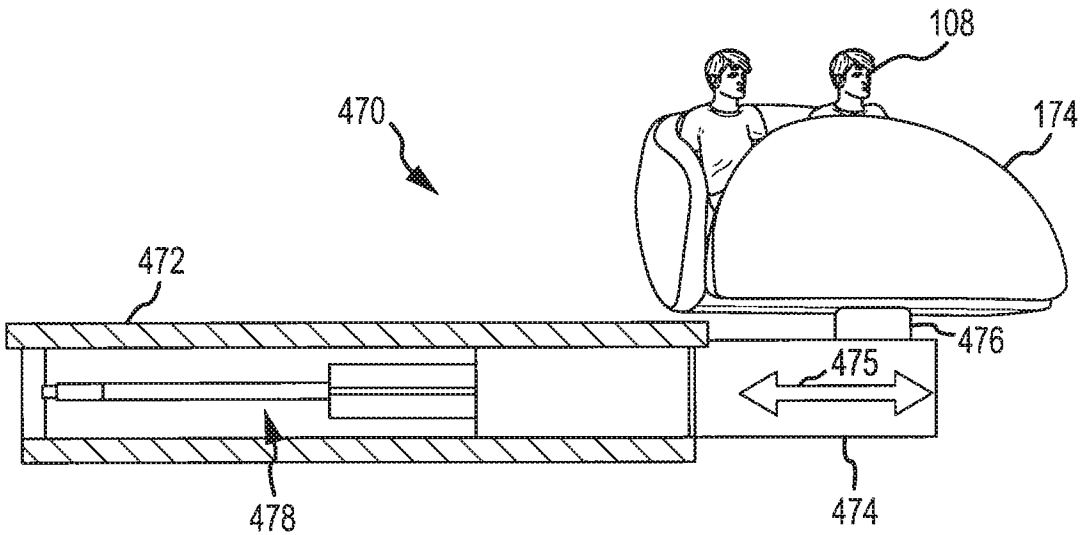
FIG. 4 is side sectional view of a portion of turntable assembly showing one embodiment of a translation mechanism useful for providing a 1 DOF connection with radial repositioning of a vehicle.

FIG. 4 illustrates an exemplary translation mechanism 470 that may be used to mount a passenger vehicle 174 onto a turntable (not shown in FIG. 4 but may take the form of turntable 162 of FIG. 1). The translation mechanism 470 is adapted to provide a 1 DOF connection by moving the vehicle 174 and its passengers 108 radially inward and outward as shown by arrow 475 such as inward to a load/unload position with a first radius relative to the rotation axis of the turntable and then outward to a show position(s) with a second radius greater than the first radius.

To this end, the translation mechanism 470 includes a channel or chamber member 472 that may be rigidly attached to the lower surface (or upper surface) of the turntable such that it is rotated about the rotation axis of the turntable with the turntable. A support arm or boom 474 is provided that can be received within an inner chamber of the member 472 to slide in and extend out as shown with arrow 475. The vehicle 174 is coupled (rigidly or for pivotal movements) to the support arm 474 to move in and out with the support arm 474. A piston assembly or linear actuator 478 is provided in the inner chamber of the channel member 472 to selectively (e.g., in response to control signals from a ride control system) move 475 the support arm 474 to set the radial position of the vehicle 174. Typically, when the piston assembly 478 is fully withdrawn, the support arm 474 is moved 475 to a minimum radial position, and the vehicle 174 is positioned adjacent the upper surface of the turntable. When the piston assembly 478 is fully extended, the support arm 474 is moved 475 to a maximum radial position, and the vehicle 174 is positioned a distance spaced apart from the turntable (such as 5 to 30 feet or further from an outer edge or side of the turntable).

Figure 5:
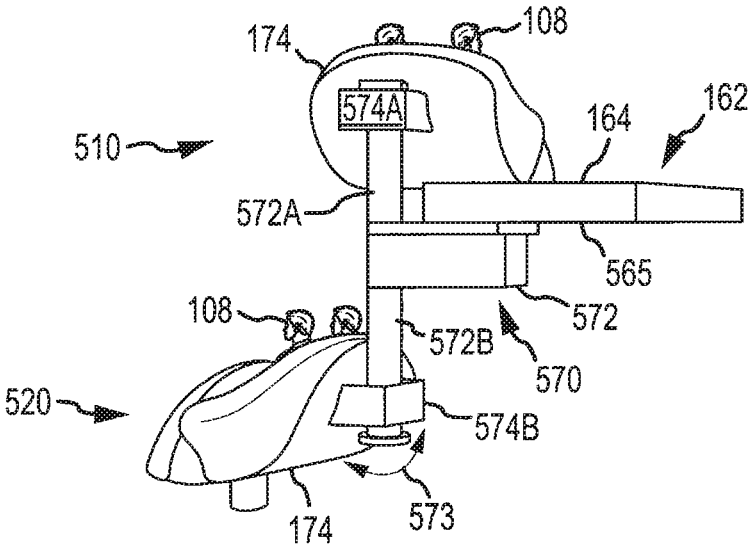
FIGS. 5-7 illustrate three exemplary translation mechanisms or vehicle attachment assemblies that are each adapted to mount a vehicle on a turntable so as to provide the vehicle with multiple DOF during rotation of the turntable with each figure showing the vehicle and the translation mechanism in a station position and in a show position.
Figure 6:
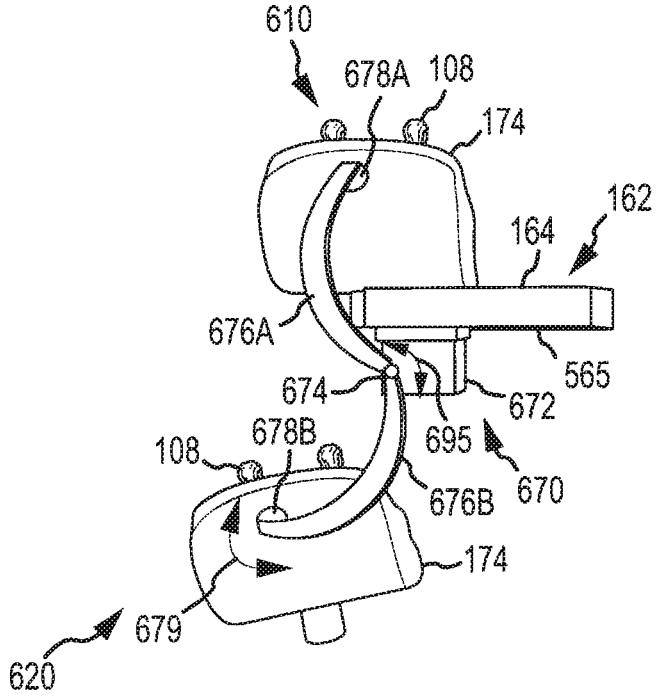
Figure 7:
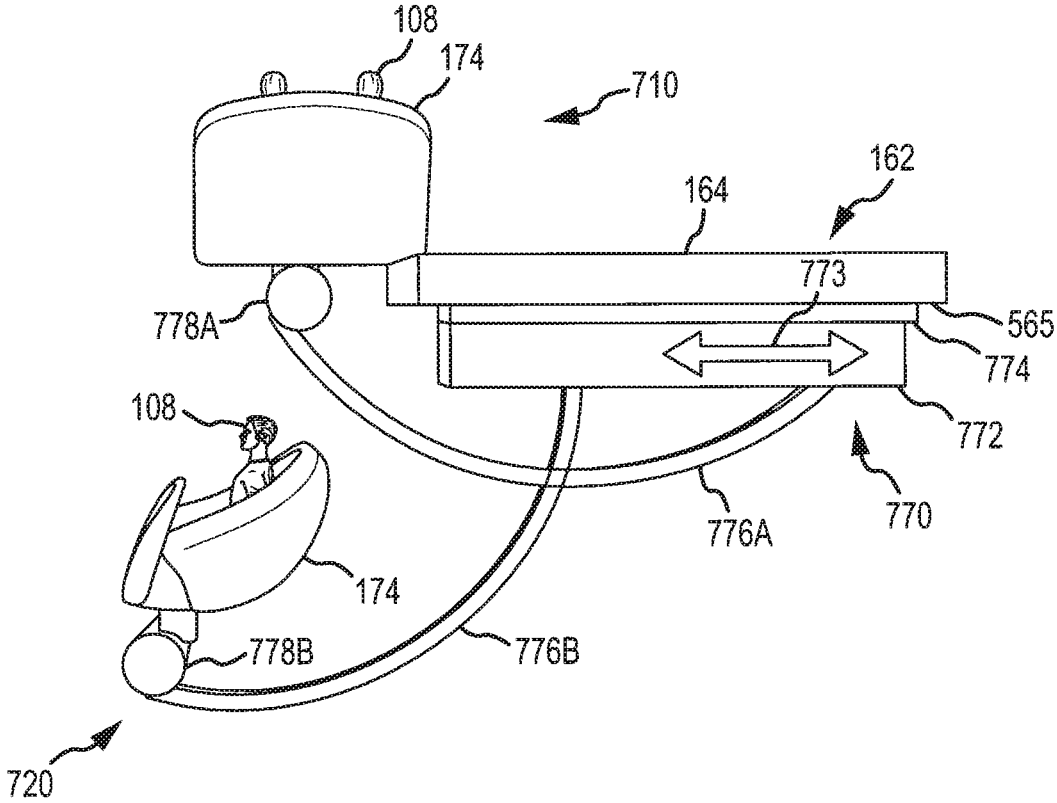

FIGS. 5-7 illustrate multiple DOF connection examples of translation mechanisms. These mechanisms may be used in omnitable ride systems to place a passenger vehicle in a load/unload position and to also move the vehicle away from turntable to a show position or to show positions while also providing vehicle movements that may be controlled by a ride controller using a ride program, by mechanical techniques as the vehicle moves along its circular ride path, and/or based on user input provided via an interactive device provide in or on the vehicles.

FIG. 5 illustrates a portion of a ride system with a translation mechanism 570 in a load/unload position 510 and in a show position 520. The translation mechanism 570 includes a horizontal support member 572 attached to a lower surface 565 of the turntable 162 such that the support member 572 rotates with the turntable 162 about the rotation/center axis of the turntable 162. In the load/unload position 510, the translation mechanism 570 is operated such that a vertical support member or arm 572A is extending upward a vertical distance above the turntable 162. A vehicle coupler 574A is shown to attach the passenger vehicle 174 to the vertical support arm 572A, and in the load/unload position 510, the vehicle 174 is positioned adjacent or on the upper surface 164 of the turntable 162. The support arm 572A may also be rotated about its longitudinal axis such that the vehicle 174 is oriented to face "forward" along the ride path or in some other orientation to facilitate loading and unloading of passengers 108 from surface 164 of turntable 162.

FIG. 5 also shows the translation mechanism 570 in the show position 520. In this configuration, the support arm 572B is shown to extend downward a distance below the horizontal support 572 and upper surface 164 of the turntable 162. The arm 572B may be rotated or slid from its position in the load/unload position 510 or the vehicle coupler 574B may slide along the support arm 572B. The vehicle coupler 574B is shown to be at low end of the vertical support arm 572B such that the vehicle 174 is in a show position that is at a lower height or elevation relative to the upper surface 164 of the turntable 162. In this way, a first DOF provided by the translation mechanism 570 is heave (or up and down movements). The vertical support arm 572B may also be rotated as shown with arrow 573 about its longitudinal axis to provide a second DOF in the form of yaw. In this manner, the translation mechanism 570 is effective for positioning the vehicle in at least an unload/load position and a show position, which differ at least in height/elevation relative to the turntable.

FIG. 6 is similar to FIG. 5 in that it shows a portion of a ride system using another translation mechanism 670 in a load/unload position 610 and in a show position 620. The translation mechanism 670 is adapted to provide three DOF movement of a passenger vehicle 174. To this end, the translation mechanism 670 includes a table mount element or member 672 that is fixed to the lower surface 565 of the turntable 162. A support arm 676A, 676B is pivotally mounted to the table mount element 672 at pin or coupler 674, and this support arm may be arcuate in shape as shown or take other forms such as liner rod or the like.

In the load/unload position, an actuator in the table mount element 672 may be operated by a ride controller to pivot 675 about pin 674 to rotate the support arm 676A upward until the vehicle 174 is placed adjacent or on the upper surface 164 of the turntable 162. The vehicle coupler 678A may allow pivoting 679 of the vehicle 174 to orient the vehicle 174 (e.g., to be horizontal) to support loading/unloading of passenger 108 via turntable surface 164. In the show position 620, the actuator in the table mount element 672 is operated to rotate or pivot the arm 676B such that the vehicle 174 is moved radially outward away from the turntable 162 and then downward to a desired height or elevation that is the same or lower than the upper surface 164 of the turntable 162. The vehicle coupler 678B may also be operated to pivot or roll 679 the vehicle 174 to maintain a horizontal or level orientation or to provide other ride dynamics. In this way, the translation mechanism 670 provides a 3 DOF vehicle connection that provides movements in the X or radial direction relative to the turntable (or its rotation axis), provides heave or changes in the height of the vehicle 174 relative to the upper surface 164 of the turntable 162, and also provides roll of the vehicle 174 relative to the vehicle coupler 678B as shown with arrow 679.

FIG. 7 illustrates a portion of an omnitable ride system that utilizes translation mechanism 770 to provide a 4 DOF vehicle connection to the turntable 162. To this end, the vehicle 174 may be placed in a load/unload position 710 by operating actuators in the translation mechanism 770 to place the support arm 776A, which may be arcuate in shape as shown, in the position shown and further to use vehicle coupler 778A to orient the vehicle 174 as shown. The translation mechanism 770 includes a horizontal support or table mount element 774 that is attached to the lower surface 565 of the turntable 162, and a arm support channel or chamber member 772 is provided that is operable to support an inner or first end of the support arm 776A. The channel 772 includes a piston or linear actuator for moving the end of the arm 776A radially inward and outward as shown by arrow 773 to move the arm between the load/unload position 710 and the show position 720. Further, channel 772 may include an actuator to pivot the arm 776A, 776B to cause it to rotate about its connection to the channel 772.

As shown in the load/unload position 710, the arm 776A has its first end moved 773 to a first or minimum radial location in the channel 772 and is rotated upward. This causes the vehicle 174 to be positioned adjacent the upper surface 164 of the turntable 162. The vehicle coupler 778A is also operated to rotate the vehicle on the end of the arm 776A such that the vehicle 174 is oriented properly (such as facing forward and with its body at horizontal) for loading and unloading of passengers 108 via turntable surface 164. In the ride position 720, the arm 776B has its first end moved 773 radially outward to a second or maximum radial location in the channel 772 and is rotated downward away from the turntable 162. This causes the vehicle 174 to be positioned at a radius that is greater than the outer edge of the turntable 162 (or the radius of the vehicle in the load/unload position 710) and also to be at a height or elevation relative to the turntable surface 164 that is the same or, as shown, below the surface 164.

The vehicle coupler 778B may also be operated to provide movement of the vehicle 174 such as to provide roll and/or yaw. In this manner, the translation mechanism 770 provides 4 DOF in the form of heave, yaw, roll, and radial movement (or in the X direction). By providing heave and radial movement, the vehicle 174 may be placed in a show position that may be different elevation than used for load/unloading and may be a greater radius relative to the rotation axis of the turntable such that the vehicle speed may be varied during the show (or at least increased from the load/unload vehicle speed due to the increased vehicle radius at the same turntable rotation rate).

One aspect of the invention is that use of a rotation turntable to provide an omnimover allows vehicles to be moved along a generally circular path that can be divided up into a load/unload station or space and also one or more show spaces. Further, it may be useful to change the radial location of the vehicles to move the vehicles through show elements or along a ride path defined by varying vehicle radii, which changes vehicle dynamics including vehicle velocity while allowing the turntable rotation rate to be held constant.

Figure 8A:
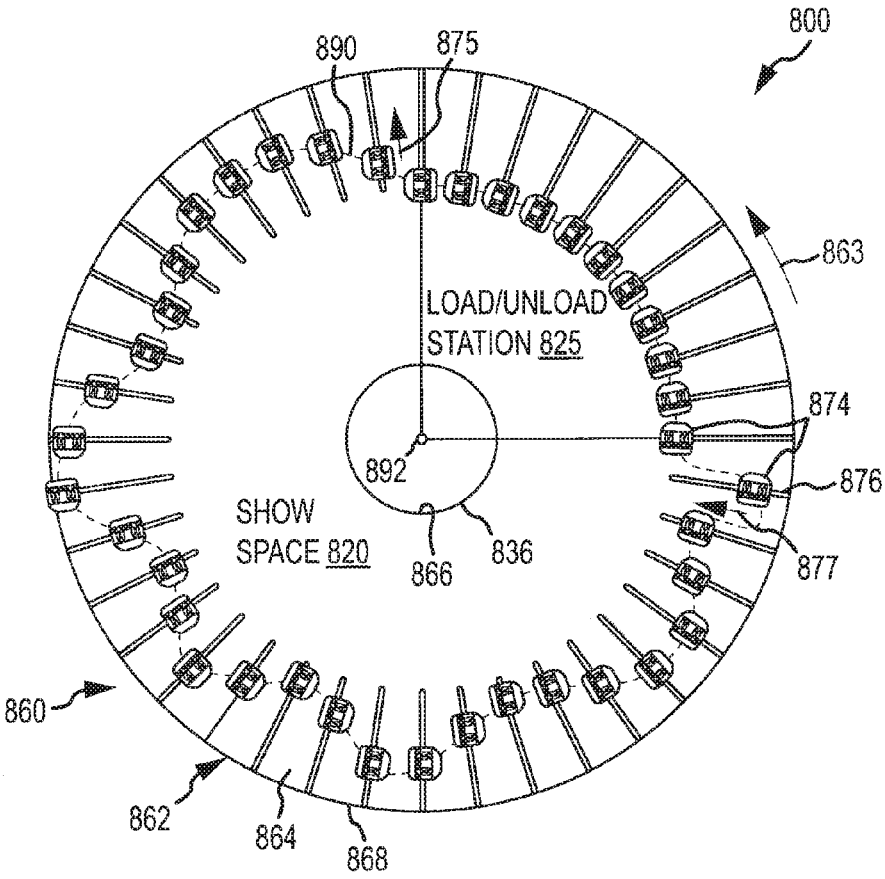
FIGS. 8A and 8B illustrate top and sectional side views of an omnitable ride system that provides radial movement of the vehicles in a manner differing from that used in the embodiment of FIG. 4.
Figure 8B:
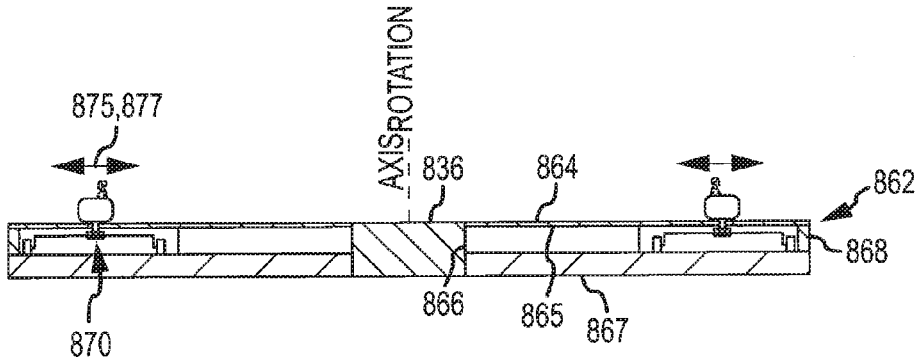

With this in mind, FIGS. 8A and 8B provide top and side views of an omnitable ride system 800 that is adapted to allow vehicles to be moved in and out on radial tracks as a turntable is rotated. As shown, the ride system 800 includes a stationary or non-rotating central platform 836, and a rotation axis, $Axis_{Rotation}$, extends through the center point 892 of this platform 836. A turntable assembly 860 is provided that includes a turntable 862 that may take the form of a planar structure that is donut shaped with a hole or opening in its center defined by inner sidewall 866 for receiving the stationary platform 836. The upper surface 864 of the turntable 862 may be coplanar with an upper surface of the platform 836 to allow passengers 876 to walk across the platform 836 and turntable surface 864 for loading/unloading. The size of the turntable 862 is defined by an outer sidewall or edge 868 that may have a diameter of 60 to 100 feet or more in some embodiments, while the inner platform 836 and inner sidewall 866 may have a smaller diameter such as 20 to 50 feet or the like. During operation of the ride system 800, the turntable 862 is rotated about the rotation axis, $Axis_{Rotation}$, as shown at 863.

As shown, the turntable assembly 860 includes a plurality of vehicles 874 for seating passengers 876. The turntable 862 may have an upper wall 865 providing the upper surface 864 used for loading/unloading and also may have a spaced apart lower wall 867 and outer sidewall 868. The vehicles 874 are each mounted to the lower wall 867 of the turntable 862 via a translation mechanism 870. The upper wall 865 may include a plurality of linear slots or grooves 876, and the translation mechanism 870 is operable to move 875, 877 the vehicle 874 radially in and out on a radial track, with a support extending between the vehicle 874 and the radial track of translation mechanism 870 through the linear grooves or slots 876.

The ride system 800 is divided into a load/unload station or space 825 and a show space 820, with the load/unload station 825 typically being a smaller fraction of the ride path such as less than about 30 percent (with a fraction of one fourth being shown in FIG. 8A). The translation mechanism 870 is shown to be operated, by a ride controller or mechanical devices, to move the vehicles radially inward 877 as the vehicles 874 are approaching the load/unload station 825. Hence, the vehicles 874 are placed and retained at a load/unload position in which they have a minimum radius and move relatively slowly. Then, when the vehicles exit the station 825 and pass a dispatch point as shown with arrow 875, the translation mechanism is operated to move the vehicle 874 radially outward to a larger or even maximum radius.

This radial in and out movement 875, 877 provided by the translation mechanism 870 defines a ride path 890 that the vehicles 874 follow as the turntable 862 is rotated about the rotation axis, $Axis_{Rotation}$. The length of the groove/slot 876 (and/or radial track of the translation mechanism 870) may be varied to practice the invention, but it may be relatively large such as 30 feet or more to provide a significant amount of variability in the ride dynamics including changes in vehicle speed with changing vehicle radii. In some cases, all vehicles 874 follow a single ride path 890 while in other embodiments the ride path 890 may differ such as by allowing a passenger to provide input via a joystick, a steering wheel, or other interactive device to move their vehicle 874 in or out (e.g., the user input may cause the translation mechanism 870 to move the vehicle along the radial track without restraint or within a predefined range or window based on an angular location of the vehicle or place in the show space 820).

As discussed, the main turntable is rotated at a constant rate during normal ride operations. Passengers load from a station area where vehicle motion is relative to the rotating turntable is disabled and vehicles are located adjacent to the upper surface of the turntable for convenient loading and unloading. Rotation of the turntable is induced or provided by a drive system or mechanism that may involve motorized casters attached under the table running on a traction surface, but the drive system may also use a pinch drive, a linear magnetic drive, or other useful propulsion system. The turntable may be driven at a fixed and constant speed during normal show operations and constrained to follow a circular path (e.g., rotate about a center rotation axis) by a track, guide, or bearing assembly. A power distribution system may be included in a ride system to provide power and control signals to equipment on the moving turntable assembly.

Figure 9:
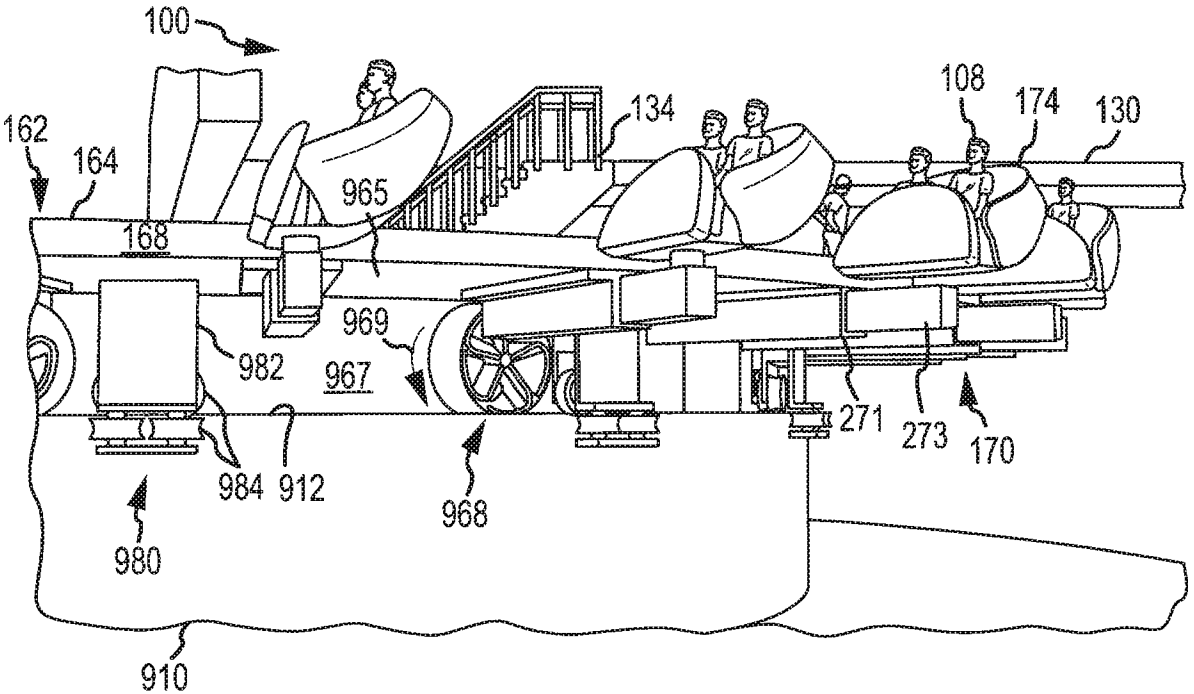
FIG. 9 illustrates a portion of the ride system of FIGS. 1 and 2 showing portions of the drive mechanism in further detail.

FIG. 9 illustrates one example of how some of these features of a drive mechanism may be provided in the ride system 100. As shown, the turntable 162 includes a lower mounting surface 965 to which the translation or attachment assemblies 170 may be affixed to support the passenger vehicles 174. The turntable 162 may further include a central hub 967 that extends downward from the lower mounting surface 965 and has a smaller diameter than the outer sidewall 168 of the turntable 162. A plurality of drive or load wheels 968 may extend out from the hub 967 and be driven to rotate 969 by motors or other drive devices. The ride system 100 further includes a base element 910 that provides a fraction or guide surface 912 upon which the drive wheels 968 may ride, and the base element 910 may also be cylindrical in shape similar to the hub 967 but with a greater diameter to provide the fraction surface 912 for wheels 968.

When the wheels 968 are rotated by their corresponding drives (not shown), the hub 967 and turntable 162 rotate. To ensure that the movement is along a circular path (or the hub 967 is forced to rotate about its center axis), a plurality of side guide assemblies 980 are provided in ride system 100 (e.g., in the drive assembly). Each guide assembly 980 includes a mounting frame 982 attached to and extending downward from the lower mounting surface 965 of the turntable 162, and one or more horizontal and vertical guide wheels may be provided (with two each shown per assembly 980) to mate with the base 910 and/or the fraction or guide surface 912. By providing the guide assemblies 980 at two, three, or more (as shown) locations about the perimeter of the turntable 162, the turntable 162 is forced to rotate about its center axis and the drive wheels 968 are guided to stay on fraction surface 912 of base 910.

Several of the above embodiments, including ride system 100, may be limited to a single rotation ride cycle. Specifically, the show space in a single ride rotation ride cycle would be adapted for a single ride path, which may have a preset and, typically, a single elevation or height above the surface of the turntable. However, it may be preferable in some cases to provide a two (or more) rotation ride cycle because this would allow every other vehicle about the perimeter of the turntable to be separated in the ride timing and, thus, in a physically different space. It also allows for a slower turntable rotation, which minimizes the relative speed which passengers must crossover between the fixed platform and the rotating turntable. This two rotation ride cycle configuration would allow passengers to board moving vehicles directly from the moving turntable further simplifying load/unload and allowing for larger vehicle spacing (between adjacent vehicles moving through a particular portion of the show space or along a particular length of the ride path) and variable speed in the show space (e.g., varying vehicle radii may be used to provide a range of vehicle speeds).

Figure 10:
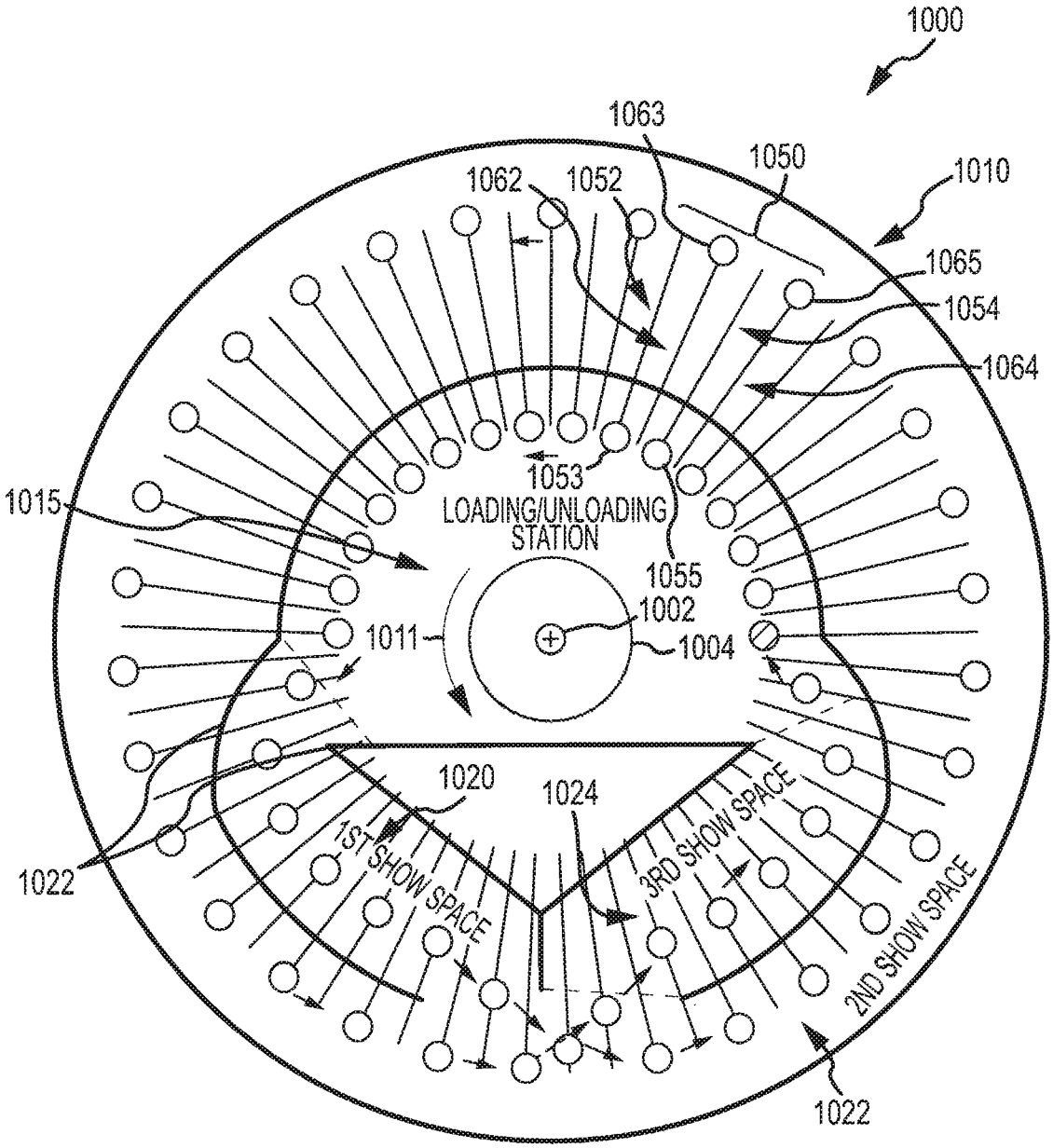
FIG. 10 is a schematic top or plan view of a 2-rotation ride cycle embodiment of an omnitable ride system.

FIG. 10 shows a 2-rotation ride cycle embodiment of an omnitable ride system 1000 useful for providing greater vehicle spacing and also varying vehicle speeds. As shown, the ride system 1000 includes a stationary or non-rotating platform 1004 through which the rotating axis of the turntable structure passes through center point 1002. The stationary platform 1004 may be used as part of the central or interior loading point for ride system vehicles. The ride system 1000 includes a turntable 1010 that is rotated 1011 about the center axis 1002.

The ride path and space is divided up into a loading/unloading station or space 1015 and first, second, and third show spaces 1020, 1022, 1024. The space may be divided and defined in part by interior walls or curtains 1022 extending downward from a ceiling (not shown). In the loading/unloading station 1015, passengers load and unload from vehicles that are spaced at minimum or some smaller, predefined radial position. The vehicles then are moved out of the station 1015 with additional rotation 1011 of the turntable 1010 through a transition or dispatch point into a first show space 1020 and the vehicles may be at a second or intermediate radial location greater than the loading/unloading location. The vehicles may also be raised (or lowered in some cases) to a height/elevation above the upper surface of the turntable 1010.

Then, the vehicles are moved to greater radial position to move into the second or outer show space 1022. As shown, the vehicles in this outer space 1022 are much further spaced apart than in the loading/unloading station 1015 and even than in the first show space. The vehicles in this second show space 1022 also would be moving at a greater velocity than in the station 1015 and first show space 1020 as they are at a greater radius relative to the rotation axis 1002. The second or outer show space 1022 may consume all or nearly all of a full rotation of the turntable 1010 and, when this full rotation is completed, the vehicles are transition into a third show space 1024 at a smaller radius (such as one equal to the radial position used for the first show space although this is not required), which causes the vehicles to slow down. Finally, with further rotation 1011 of the turntable 1010 the vehicles move back into the station 1015 for unloading and then loading, and the translation mechanism supporting each vehicle moves the vehicles radially inward and, in some cases, also changes their elevation or heights to place the vehicles on or adjacent to the upper surface of the platform 1010.

It may be useful to discuss a set 1050 of four adjacent vehicles 1053, 1055, 1063, 1065. Every other vehicle is assigned to a different ride path or point along the ride path, and each is supported on the turntable 1010 by a separate translation mechanism 1052, 1054, 1062, 1064 (such as a radial track configuration, a sliding support arm, a pivotal support arm, or the like). As shown, vehicles 1053, 1055 are in the same ride path/location set and are positioned by their translation mechanisms 1052, 1054 to be in a load/unload position and the vehicles 1053, 1055 are traveling through the station 1015 at a minimal or first radius. Concurrently, adjacent (every other) vehicles 1063, 1065 are in the same ride path/location set and are positioned by their translation mechanisms 1062, 1064 at a maximum or second radius (a show position associated with the second show space 1022) that is much larger than the radius associated with the loading/unloading station 1015. As a result, the vehicles 1063, 1065 are adjacent in the show space 1022 (but not on the turntable perimeter) but are significantly more spaced apart than would be the case if a single rotation cycle were utilized.

Figure 11A:
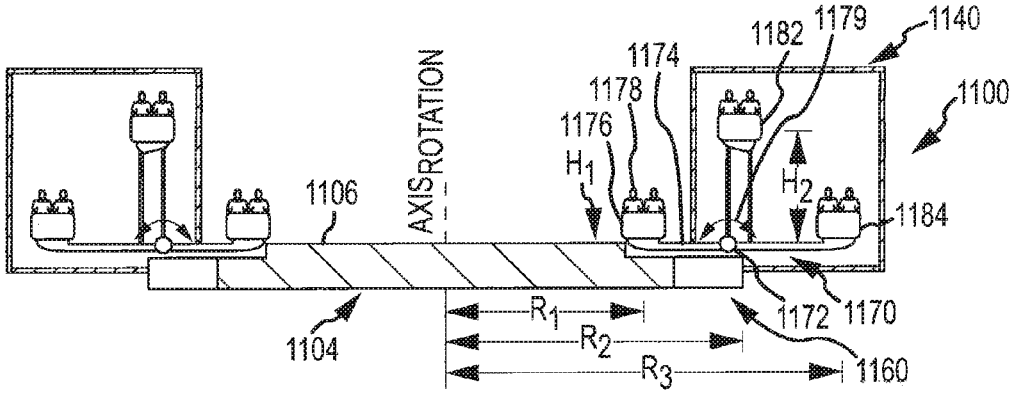
FIGS. 11A and 11B provide a side sectional and a top/plan schematic view of another 2-rotation ride cycle embodiment of an omnitable ride system.
Figure 11B:
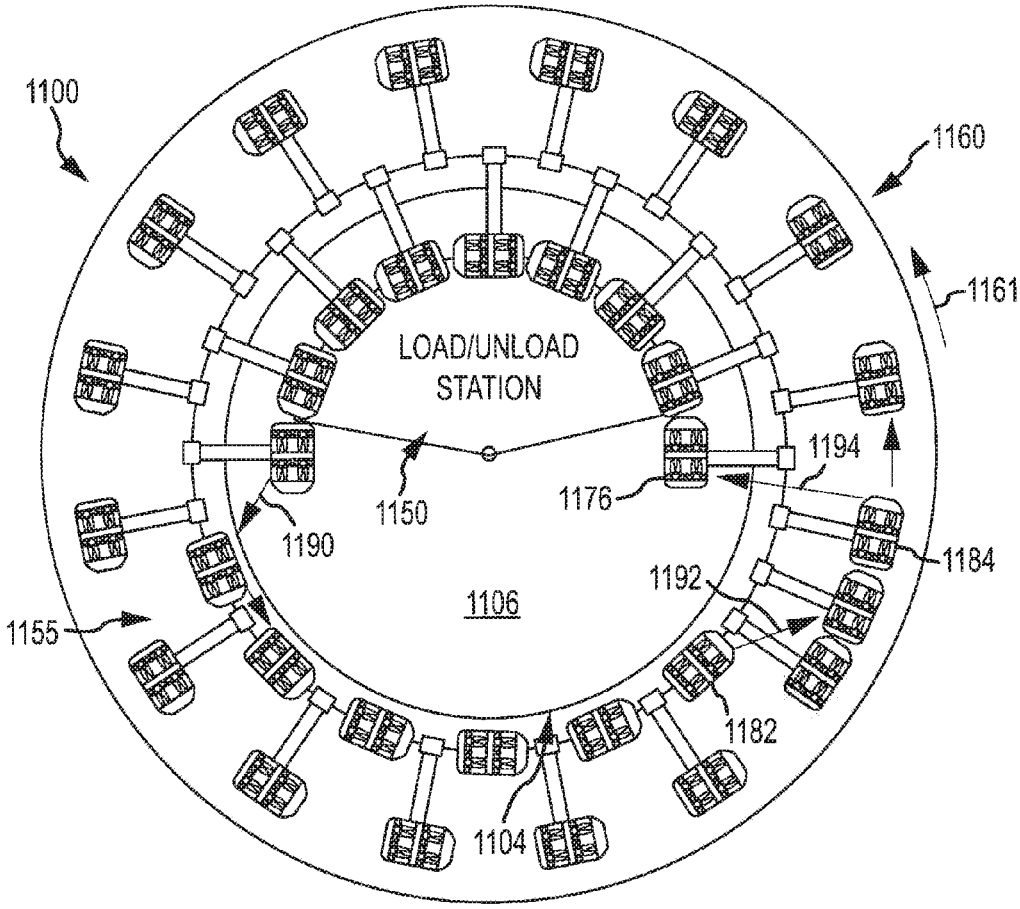

FIGS. 11A and 11B illustrate a side sectional and top view, respectively, in a schematic manner showing another example of a 2 rotation ride cycle embodiment of a ride system 1100. The ride system utilizes a translation mechanism 1170 that is adapted to not only change the radial position of a vehicle but also change its height/elevation relative to the turntable upper surface so that show elements and spaced can be provided at differing heights relative to the turntable. The ride system 1100 is shown to include a stationary central platform 1104 through which the rotation axis, $Axis_{Rotation}$, for the turntable 1160 extends. The platform 1104 provides an upper surface 1106 that may be used by passengers for walking upon to load and unload a vehicle without need to over a transition point. To this end, the ride system 1100 includes a turntable 1160 that is rotated about the peripheral edge of the stationary platform 1104.

The translation mechanism 1170 for each vehicle, such as vehicle 1176 is mounted onto the turntable 1160 to rotate with the turntable as shown with arrow 1161. The ride system is divided up into a load/unload station or space 1150 in which passengers enter into the vehicles and a show space 1155 that is used to provide a show. The ride system 1100 is a 2-rotation embodiment, and, as shown, the load/unload station 1150 only takes up less than one half of a single rotation, which means that the show space can be provided for over one and a half rotations of the turntable 1160.

To this end, the translation mechanism 1170 may first operate to place a vehicle such as vehicle 1176 into a load/unload position for use as the vehicle 1176 rotates through the station 1150 to unload and load passengers 1178. Each translation mechanism 1170 includes a pivoting or rotational actuator 1172 that is supported upon the turntable 1160 and is selectively operable to pivot 1179 a support arm or boom 1174, which supports the vehicle 1176 (e.g., with a pivotal coupling at the end of the arm 1174). As shown, the translation mechanism 1170 rotates 1179 the arm 1174 to place the vehicle 1176 at the load/unload position in which it has a height, $H_1$, that is equal to the height of the upper platform surface 1106 (or a height that places the vehicle 1176 adjacent to the surface 1106 for loading/unloading such placing the floor of vehicle body in a coplanar relationship with the upper surface 1106). The vehicle 1176 is also placed at a minimum or first radius, R1, such as 30 to 50 feet or the like.

As a vehicle such as vehicle 1182 passes a dispatch point as shown by arrow 1190 in FIG. 11B, the translation mechanism 1170 may operate to rotate 1179 the support arm 1174 up and away from the platform 1104. This rotation 1179 may be set to be 75 to 105 degrees or the like (with 90 degrees shown in FIG. 11A) so as to place the vehicle 1182 in a first shown position that is defined by a second height, $H_2$, and also a second vehicle radius, $R_2$, which are both greater than these values for the vehicle 1176 in the load/unload position. For example, the second height, $H_2$, may be 10 to 20 feet or more about the platform surface 1106 and the second radius, $R_2$, may be 50 to 70 feet or the like. A show assembly 1140 may be used to separate the show space 1155 from the load/unload station 1150 and it may present show elements to the vehicle 1182 it this first show position. The vehicle 1182 may then stay in this first ride position for a full or a portion of a rotation cycle of the turntable 1160, with arrow 1192 providing an example where the first show position is retained for a fraction of a rotation (such as one fourth to one half of a rotation).

Then, after transition 1192, the translation mechanism 1170 is operated via actuator 1172 to rotate or pivot 1179 the support arm or boom 1174 to move the vehicle 1184 into a second ride position defined by a third radius, $R_3$, and new height (which may be the same as the first height, $H_1$, or greater/less than the first height, $H_1$). The third radius, $R_3$, is greater than the second radius, $R_2$, such as by the full support arm length or some fraction thereof, e.g., a radius of 70 to 120 feet or the like. The translation mechanism 1170 may retain the vehicle 1184 in this second show position for a full rotation, as shown, a fraction of a rotation, or more than a full rotation. At a transition point 1194, the vehicle 1184 may then be moved to the position shown for vehicle 1176 for moving from the show space 1155 into the load/unload station 1150. Again, every other vehicle may be placed in a different portion of the ride path to provide greater vehicle spacing in the show spaces.

A wide range of design parameters may be used to implement the ride system 1100. However, it may be useful to provide some exemplary values that may be used for the system 1100. In one case, $R_1$ is about 40 feet, $R_2$ is about 60 feet, and $R_3$ is about 80 feet. The turntable 1160 has a diameter of 60 feet (as measured to its outer edge and about where the pivoting actuator 1172 of translation mechanism 1170 may be mounted) and is rotated 1161 at a rate of about 0.48 revolutions per minute. The length of the support arm 1174 was chosen to be 20 feet (but a smaller arm such as a 10-foot arm may also be useful) and the load/unload station 1150 was set to be 158 degrees of a 360 degree rotation. As a result, the vehicle speed at $R_1$ was 2 FPS, at $R_2$ was 3 FPS, and at $R_3$ was 4 FPS. Hence, the speed was varied 50 and 100 percent as it is moved from the load/unload station 1150 into the two show positions, which is a very significant variance in vehicle speed not previously provided in an omnimover ride (e.g., the speed can easily be doubled or more with the ride system 1100).

Figure 12:
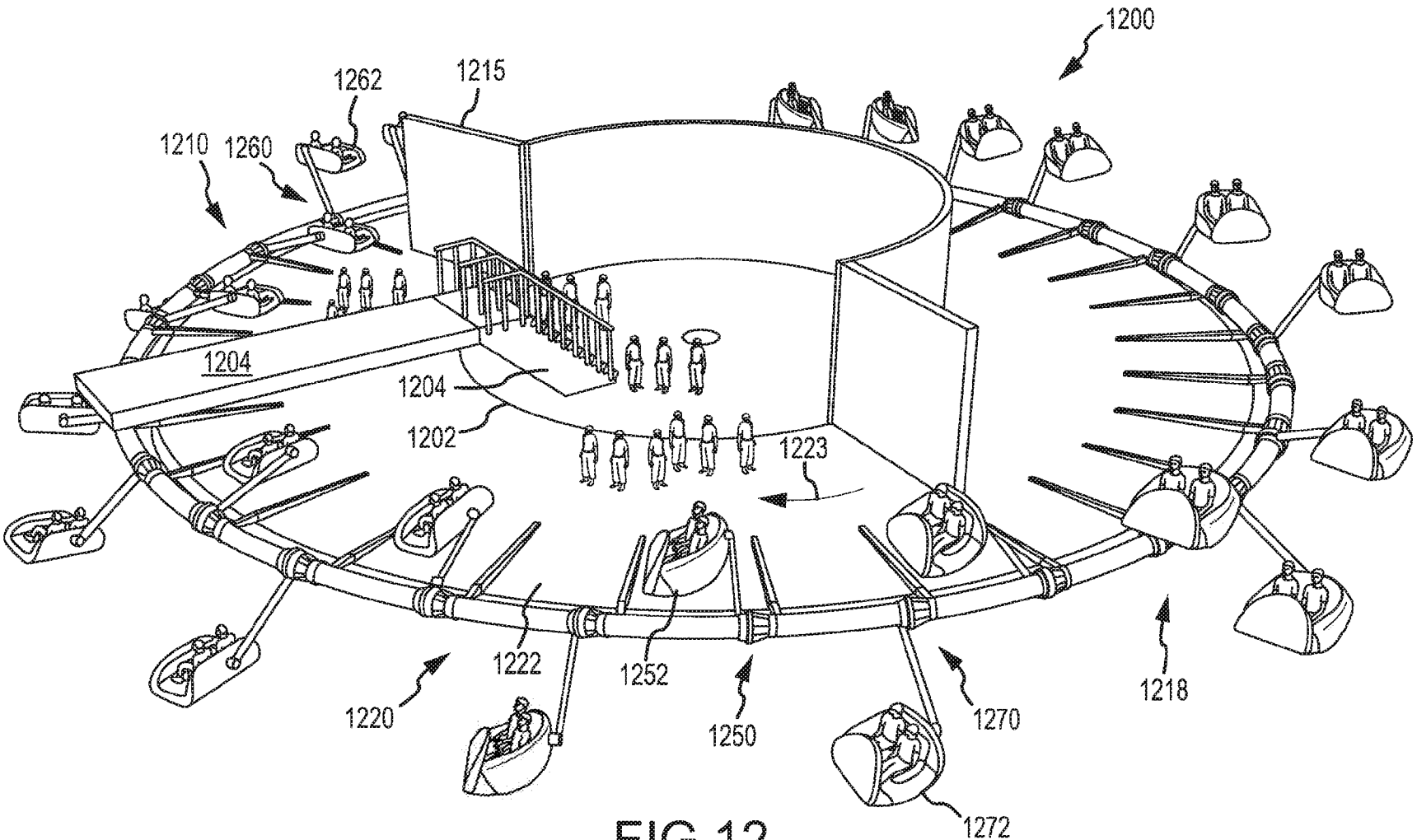
FIG. 12 illustrates a partial perspective view of an omnitable ride system utilizing translation mechanisms to place vehicles in a load/unload position on the turntable and also two show positions that enable the ride path to involve two full rotations of the turntable.

In some cases, it may be desirable to have the vehicles landed on (or near) the upper surface of the turntable to facilitate loading and unloading. Further, it may be desirable that the support arm of the translation mechanism be adapted to position the vehicle below the turntable and not just above or even with the upper surface of the turntable. FIG. 12 illustrates such an omnitable ride system 1200. In the system 1200, a stationary or non-rotating center platform 1202 is provided and a walkway or bridge 1204 and stairs 1206 are provide to allow passengers to walk over a moving turntable 1220 into a loading/unloading station or space 1210 of the ride system 1200. A tunnel under the omnitable system with stairs leading up to the stationary platform may also be used to get people to and from the station area. The ride system 1200 includes a turntable 1220 that is rotated as shown at 1223 about the center axis extending through the platform 1202, and an upper surface 1222 is provided for the passengers to walk over to load and unload vehicles in the load/unload station 1210 such as vehicle 1252.

A plurality of vehicles are provided about the periphery of the turntable 1220 and are supported by translation mechanism that are affixed to the upper surface 1222 of the turntable 1220 to rotate 1223 with the turntable 1220. The system 1200 is divided into a load/unload station or space 1210 and a show space 1218, with the two spaces 1210, 1218 separate in part by stationary walls 1215 and also by the turntable 1220 itself as some vehicles are positioned below the turntable during at least a portion of one rotation of the turntable 1220. In this example, the translation mechanism 1250 is shown to be operated to place its supported vehicle 1252 onto (or near) the upper surface 1222 of the turntable 1220.

As the rotation 1223 continues, vehicles transition out of the station 1210 and into the show space 1218. The translation mechanism 1260 is shown to be operated to lift its vehicle 1262 up off the surface 1222 and into a first show position, e.g., a position with a greater vehicle radius and a greater height/elevation than the surface 1222. This position may be held for about one half of a full rotation (or some other fraction of a rotation depending upon the size of the station 1210). Then, the vehicles are transitioned into a second show position below the turntable. For example, transition mechanism 1270 is shown to be operated to rotate the vehicle 1272 with support arm below the upper surface 1222 of the turntable 1220 such as at an angle of 30 to 60 degrees or the like below horizontal (or a rotation of greater than 180 degrees from the position shown for vehicle 1252 such as 210 to 240 degrees).

Figure 13:
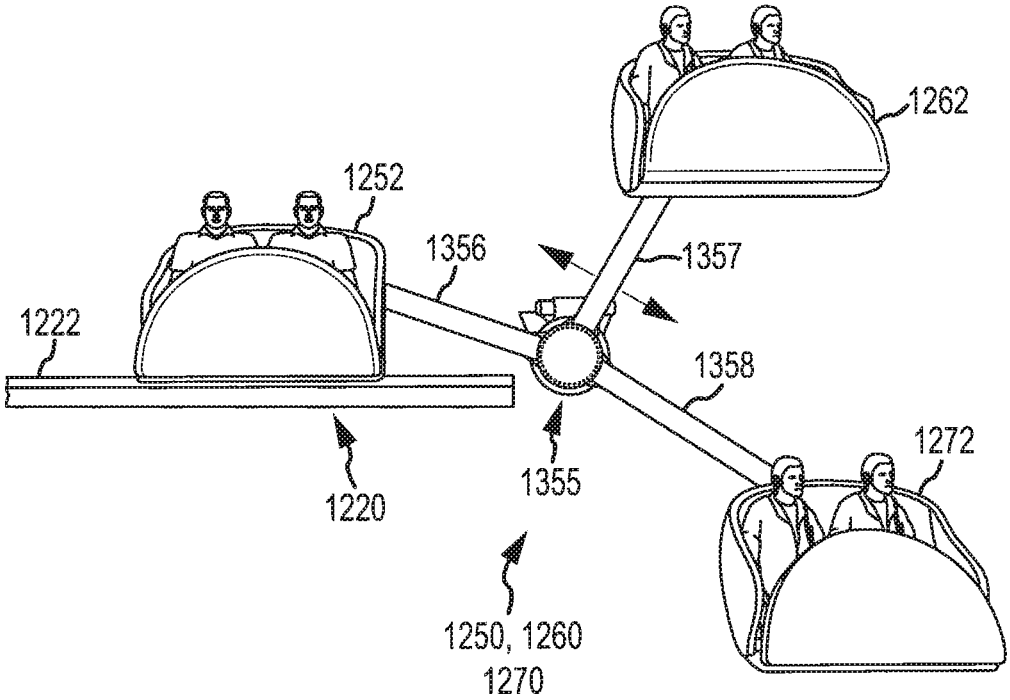
FIG. 13 illustrates a partial end view of the ride system of FIG. 12 showing three of the translation mechanisms end-to-end illustrating the range of arm and vehicle movement provided with such translation mechanisms.

FIG. 13 illustrates the three translation mechanism positions 1250, 1260, 1270 in more detail and arranged to be end to end for comparison and explanation purposes. As shown, the translation mechanism 1250 includes positioning device or pivoting actuator 1355 (e.g., a motor with gears and bearing as needed) that is selectively operable to rotate arm 1356, which is supporting the vehicle 1252. The mechanism 1250 is operated to place the vehicle 1252 in the load/unload position with the vehicle 1252 upon the upper surface 1222 of the turntable 1220 (i.e., at a first or minimum radius and a first height that is equal to or nearly equal to the height/elevation of surface 1222).

The translation mechanism 1260 also includes an actuator 1355 that is operated to pivot a support arm 1357, which is supporting vehicle 1262 at an opposite end, to place the vehicle 1262 in a first show position. In this position, the vehicle has a second height and radius that are both greater than those of the vehicle 1252. For example, the arm 1357 may be rotated through an angle selected from the range of 45 to nearly 180 degrees, and this will cause the vehicle 1262 to be at a radius that exceeds the radius of vehicle 1252 in the load/unload position and to have a height that is above the surface 1222.

The translation mechanism 1270 also includes an actuator 1355 that is shown to be operated to rotate the support arm or boom 1358, which supports vehicle 1272. This further rotation moves the vehicle 1272 out of the first show position (of vehicle 1262) to a second show position. As shown, the arm 1358 is typically rotated more than 180 degrees from the load/unload position such as 210 to 240 degrees or the like, and this causes the vehicle 1272 to be placed at a height/elevation that is below that of the upper surface 1222 of the turntable and, in some cases, at a new radial position that is greater than the load/unload position of vehicle 1252 but that may or may not exceed that of the vehicle 1262 in the first show positions (e.g., the vehicle radii in the first and second show positions may be equal or they may differ with either being larger than the other to achieve a desired ride experience).

Figure 14:
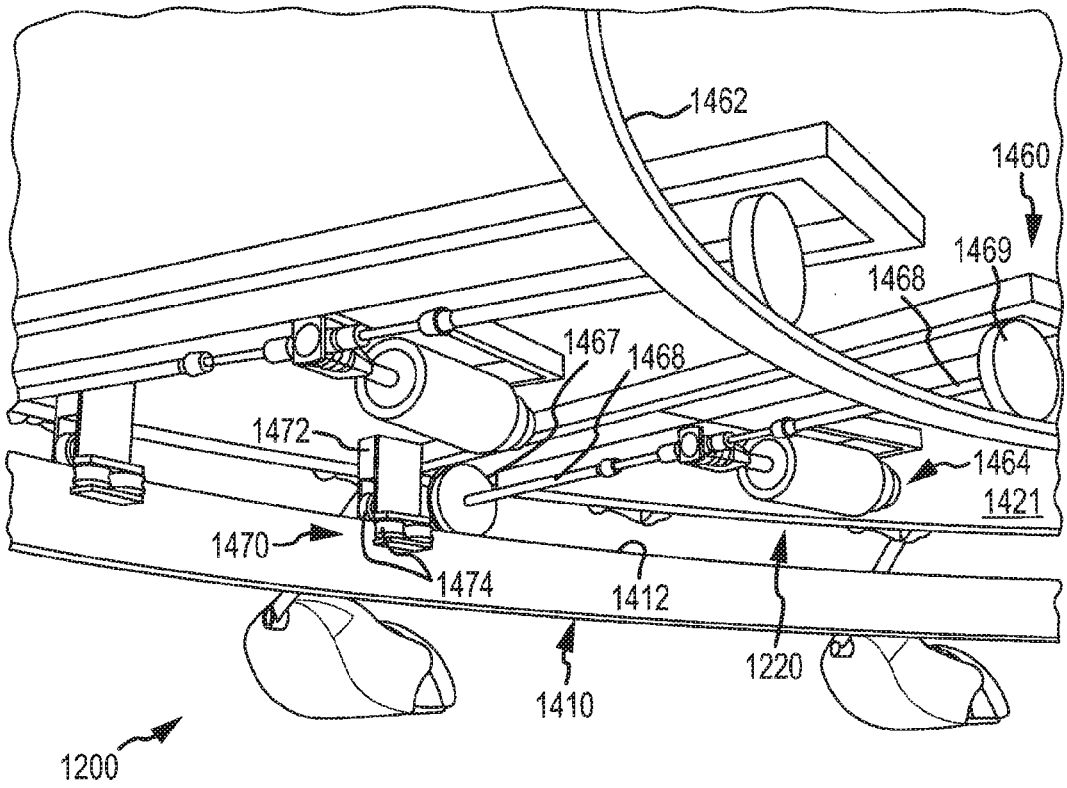
FIG. 14 illustrates partial bottom view of the ride system of FIG. 12 showing a drive mechanism or assembly that may be used as part of the drive system to rotate the turntable about its rotation axis.

FIG. 14 illustrates partial bottom view of the ride system 1200 of FIG. 12 showing a drive mechanism or assembly that may be used as part of the drive system to rotate the turntable about its rotation axis. As shown, the turntable 1220 includes a lower mounting surface 1421 and below this the ride system 1200 includes an outer track 1410 and an inner track 1462 (spaced apart a distance). Both tracks may provide a generally circular contact surface such as the support surface 1412 on outer track 1410. The drive system of the ride 1200 includes a plurality of drive mechanisms 1460 attached to the lower mounting surface 1421, which may be operated concurrently to rotate the turntable 1220 about its center axis and on a circular path.

The drive mechanism 1260 includes a motor 1464 or the like that is operated by a ride controller (not shown in FIG. 14) that rotates axles 1466, 1468 to drive load or drive wheels 1467, 1469 to rotate upon the tracks 1410, 1462 (such as at 0.4 to 0.7 RPM or the like). To retain the turntable 1220 on a circular path, a number of side guide assemblies 1470 are spaced apart about the perimeter of the turntable 1220. A support frame 1472 is affixed to the lower mounting surface 1421, and two or more side guide wheels 1474 are mounted for rotation on the frame 1472 and abut the upper contact surface 1412 and sidewall of outer track 1410.

Although the invention has been described and illustrated with a certain degree of particularity, it is understood that the present disclosure has been made only by way of example, and that numerous changes in the combination and arrangement of parts can be resorted to by those skilled in the art. In one typical embodiment of the omnitable ride system, passengers enter and exit the ride from a non-rotating or stationary platform provided at the center of the turntable. As passengers move radially outward towards the vehicles, they step across a low speed transition point (e.g., the smaller diameter or inner portion of the turntable is moving at a slower speed than the larger diameter or outer portion of the turntable) and onto the rotating turntable. Upon reaching the loading position for one of the vehicles, the passengers and vehicles are being carried by the turntable so that there is no relative motion between the portion of the turntable's upper surface moving through the station and the vehicles so that the passengers can easily load into the vehicles (and later unload from the vehicles in a reverse fashion).

Vehicles are locked, such as against the edge or top surface of the turntable, for easy loading and unloading, but, once the vehicles are moved by the turntable past a "dispatch point," the vehicles can be moved using a multi-degree of freedom motion base and/or a translation assembly to make the ride experience more interesting. Vehicles may be moved up and down, radially inward and outward, left and right (relative to the turntable), and/or with pitch, roll, and yaw to increase the passengers' interaction with and immersion into show elements provided along the ride path (e.g., thematic or show sets). The turntable is driven at a fixed and constant speed during normal show/ride operations by a propulsion system that may include on or off board friction wheels/pacers and/or magnetic propulsion elements. The turntable may be supported by load wheels and constrained to a circular path (or to rotation about a center/rotation axis) by multiple side guide assemblies. A power pickup system may be utilized that includes slip rings or bus bars to provide power and control signals to onboard (or on-turntable) systems.

A ride cycle could involve multiple rotations of the turntable in embodiments where adjacent vehicles are separated in space and ride timing at different points in the ride cycle (e.g., a first vehicle is in a show space or section of a ride cycle while a second vehicle adjacent to the first vehicle is in the station for loading/unloading or in a different portion of the show space). This has the benefit of lengthening the show and allowing for more space between adjacent vehicles in the show space.

As described, the omnitable ride system provides a completely new and immersive ride experience. The ride system provides variable vehicle spacing, variable speeds with changing vehicle radial positioning, new motions and dynamics, passenger interaction, and a different form of branching along ride paths that enhances variability and vehicle spacing. The benefits of a traditional omnimover are preserved (e.g., high capacity, continuous chain of vehicles, small/intimate vehicles, and simple propulsion and control system) while providing many new possibilities for ride experiences. The omnimover ride system may be designed to provide a large range of vehicle motion. For example, each vehicle may be mounted to the turntable to have multiple degrees of freedom while being capable of moving through a unique workspace with no hazard of collision with other vehicles and with the capability of branching paths and re-programming (e.g., changing the ride path during a ride or at a later date to redesign a ride). The show elements typically are provided on an outer show environment but may also be provided on the inner or centrally-positioned stationary/non-rotating platform.

We claim:

1. A system for providing an amusement ride with a generally circular path, comprising:

a stationary and centrally-located platform for loading and unloading passengers; and a turntable assembly comprising:

a turntable with an upper surface substantially coplanar with an upper surface of the platform, wherein the turntable has a centrally-located hole defined by an inner sidewall for receiving the platform;

a plurality of passenger vehicles mounted along an outer edge of the turntable, wherein each of the passenger vehicles is coupled to the turntable with a translation mechanism; and a drive mechanism rotating the turntable about a central axis extending upward through the platform at a substantially constant rate during operation of the ride system, wherein the passenger vehicles are moved through a station space and a show space during a rotation of the turntable about the center axis and wherein the passenger vehicles are loaded and unloaded in the station space via the platform with the drive mechanism operating to rotate the turntable.

2. The system of claim 1, wherein the rate of rotation of the turntable is selected such that vehicle rotational speed is in the range of 1 to 4 feet per second in the station space and in the show space.

3. The system of claim 2, wherein the translation mechanisms are configured and operated to position the passenger vehicles in a load and unload position when the passenger vehicle is moved through the station space and to position the passenger vehicles in a show position when the passenger vehicle is moved through the show space and wherein each of the vehicles has a vehicle radius that is greater in the show space.

4. The system of claim 3, wherein the vehicle radii are adjusted by the translation mechanism such that each of the passenger vehicles have a vehicle speed in the range of 1 to 2 feet per second in the station space and a vehicle speed that is in the range of 2 to 4 feet per second in the show space.

5. The system of claim 3, wherein the translation mechanisms are each further configured to place each of the passenger vehicles at a first height in the station space whereby each of the passenger vehicles are adjacent to the upper surface the turntable or the platform and at a second height differing from the first height in the show space.

6. The system of claim 3, wherein the translation mechanisms are operated such that adjacent vehicles are placed on a different section of a ride path for the ride system including positioning the adjacent vehicles at differing radii or heights above the upper surface of the turntable.

7. The system of claim 1, wherein each of the translation mechanisms comprise a support arm pivotally coupled to the turntable at a first end and supporting one of the passenger vehicles, the translation mechanisms each operating to pivot the support arm to place the passenger vehicle adjacent to the upper surface of the turntable or the platform as the passenger vehicle is moved through the station space and to pivot the support arm to place the passenger vehicle in a spaced-apart relationship to the upper surface of the turntable as the passenger vehicle is moved through the show space.

8. The system of claim 7, wherein each of the translation mechanisms is configured to pivot the support arm through an angular rotation of more than 180 degrees, whereby the passenger vehicles are positionable in a show position above or below the upper surface of the turntable.

9. An omnitable ride, comprising:

a turntable supported for rotation about a central rotation axis;

a drive mechanism operable to rotate the turntable;

a plurality of passenger vehicles;

a plurality of translation mechanisms, each of the translation mechanisms including a support arm with a first end coupled to the turntable and a second end supporting one of the vehicles, wherein, during a full rotation of the turntable, the translation mechanisms each operate to first place the supported one of the vehicles in a load and unload position with a first radius and to second place the supported one of the vehicles in a show position with a second radius greater than the first radius.

10. The ride of claim 9, wherein each of the translation mechanisms include an actuator operating to pivot the support arm between a first position placing the supported one of the vehicles at the first radius and adjacent an upper surface of the turntable and a second position placing the supported one of the vehicles at the second radius.

11. The ride of claim 10, wherein the vehicles at the second radius are at a vertical location above the upper surface of the turntable.

12. The ride of claim 10, wherein the vehicles at the second radius are at a vertical location below the upper surface of the turntable.

13. The ride of claim 10, wherein the second radius is selected such that the vehicles at the second radius have a vehicle speed exceeding a vehicle speed at the first radius by at least 50 percent.

14. The ride of claim 9, wherein the drive mechanism rotates the turntable at a single rate throughout operation of the ride including when the vehicles are positioned in the load and unload position.

15. The ride of claim 14, wherein the rate of rotating the turntable is in a range whereby vehicle velocity for the vehicles placed at the first radius is less than 2 feet per second.

16. A ride system for providing an omnimover ride with a circular path, comprising:

a stationary platform for loading and unloading passengers; and a turntable assembly comprising:

a turntable with a centrally-located passageway defined by an inner sidewall, the platform extending at least partially through the passageway;

passenger vehicles mounted along an outer edge of the turntable, wherein each of the passenger vehicles is coupled to the turntable with a translation mechanism; and a drive mechanism rotating the turntable about a central axis extending through the platform, wherein each of the translation mechanisms comprise a support arm pivotally coupled to the turntable at a first end and supporting one of the passenger vehicles, the translation mechanisms each operating to pivot the support arm to place the passenger vehicle adjacent to an upper surface of the turntable or the platform as the passenger vehicle is moved through a station space and to pivot the support arm to place the passenger vehicle in a spaced-apart relationship to the upper surface of the turntable as the passenger vehicle is moved through a show space.

17. The system of claim 16, wherein the turntable is rotated at a rate about the central axis that is selected such that vehicle speed is in the range of 1 to 2 feet per second in the station space and 1.5 to 4 feet per second in the show space.

18. The system of claim 16, wherein the translation mechanisms are operated such that adjacent ones of the vehicles are placed on a different section of a ride path for the ride system including positioning the adjacent vehicles at differing radii or heights above the upper surface of the turntable.

19. The system of claim 16, wherein each of the translation mechanisms is configured to pivot the support arm through an angular rotation of 180 degrees, whereby the passenger vehicles are positionable in a show position above or coplanar with the upper surface of the turntable.

20. The system of claim 16, further comprising a ride control system operating the translation mechanisms to define a ride path that extends over two full rotations of the turntable about the central axis, the operating including changing a vertical position of each of the passenger vehicles at least once in the show space, whereby the passenger vehicles pass through differing show elements and follow a differing ride path in first and second rotations of the turntable.

* * * * *